US009177562B2

(12) United States Patent
Jeong et al.

(10) Patent No.: US 9,177,562 B2
(45) Date of Patent: Nov. 3, 2015

(54) SPEECH SIGNAL ENCODING METHOD AND SPEECH SIGNAL DECODING METHOD

(75) Inventors: Gyu Hyeok Jeong, Seoul (KR); Jong Ha Lim, Seoul (KR); Hye Jeong Jeon, Seoul (KR); In Gyu Kang, Seoul (KR); Lag Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 53 days.

(21) Appl. No.: 13/989,196

(22) PCT Filed: Nov. 23, 2011

(86) PCT No.: PCT/KR2011/008981

§ 371 (c)(1),
(2), (4) Date: May 23, 2013

(87) PCT Pub. No.: WO2012/070866

PCT Pub. Date: May 31, 2012

(65) Prior Publication Data

US 2013/0246054 A1 Sep. 19, 2013

Related U.S. Application Data

(60) Provisional application No. 61/417,214, filed on Nov. 24, 2010, provisional application No. 61/531,582, filed on Sep. 6, 2011.

(51) Int. Cl.

| | |
|---|---|
| ***G10L 19/00*** | (2013.01) |
| ***G10L 19/02*** | (2013.01) |
| ***G10L 19/022*** | (2013.01) |

(52) U.S. Cl.

CPC ..... *G10L 19/0019* (2013.01); *G10L 19/022* (2013.01); *G10L 19/0212* (2013.01)

(58) Field of Classification Search

CPC ..... G01L 19/0019; G01L 19/005; G01L 19/0017; G01L 19/00

USPC ..... 704/203

See application file for complete search history.

(56) References Cited

U.S. PATENT DOCUMENTS 5,732,386 A 3/1998 Park et al.
5,787,389 A * 7/1998 Taumi et al. ..... 704/219

(Continued)

FOREIGN PATENT DOCUMENTS

CN 1132877 A 10/1996
CN 101061533 A 10/2007

(Continued)

OTHER PUBLICATIONS

Wang et al, "The Modified Discrete Cosine Transform: Its Implications for Audio Coding and Error Concealment," Jan./Feb. 2003, Journal of Audio Engineering Society, vol. 51 No. 1/2, pp. 52-61.*

(Continued)

*Primary Examiner* — David Hudspeth
*Assistant Examiner* — Oluwadamilola M. Ogunbiyi
(74) *Attorney, Agent, or Firm* — Fish & Richardson P.C.

(57) ABSTRACT

A speech signal encoding method and a speech signal decoding method are provided. The speech signal encoding method includes the steps of specifying an analysis frame in an input signal; generating a modified input based on the analysis frame; applying a window to the modified input; generating a transform coefficient by performing an MDCT (Modified Discrete Cosine Transform) on the modified input to which the window has been applied; and encoding the transform coefficient. The modified input includes the analysis frame and a self replication of all or a part of the analysis frame.

16 Claims, 44 Drawing Sheets

(56) References Cited

U.S. PATENT DOCUMENTS

| | | | | |
|---|---|---|---|---|
| 5,848,391 | A | 12/1998 | Bosi et al. | |
| 6,009,386 | A * | 12/1999 | Cruickshank et al. | 704/207 |
| 6,351,730 | B2 * | 2/2002 | Chen | 704/229 |
| 7,873,227 | B2 * | 1/2011 | Geiger et al. | 382/248 |
| 8,326,606 | B2 * | 12/2012 | Oshikiri | 704/200.1 |
| 8,504,181 | B2 * | 8/2013 | Seefeldt et al. | 700/94 |
| 2001/0023395 | A1 * | 9/2001 | Su et al. | 704/220 |
| 2002/0007273 | A1 | 1/2002 | Chen | |
| 2004/0064308 | A1 * | 4/2004 | Deisher | 704/211 |
| 2004/0181405 | A1 * | 9/2004 | Shlomot et al. | 704/241 |
| 2004/0220805 | A1 * | 11/2004 | Geiger et al. | 704/230 |
| 2005/0071402 | A1 * | 3/2005 | Youn | 708/402 |
| 2006/0095253 | A1 * | 5/2006 | Schuller et al. | 704/200.1 |
| 2007/0094018 | A1 * | 4/2007 | Zinser et al. | 704/219 |
| 2008/0027719 | A1 | 1/2008 | Kirshnan et al. | |
| 2008/0065373 | A1 * | 3/2008 | Oshikiri | 704/203 |
| 2008/0103765 | A1 | 5/2008 | Lakaniemi et al. | |
| 2008/0243491 | A1 * | 10/2008 | Matsuoka | 704/201 |
| 2009/0012797 | A1 * | 1/2009 | Boehm et al. | 704/501 |
| 2009/0030677 | A1 * | 1/2009 | Yoshida | 704/219 |
| 2009/0094038 | A1 | 4/2009 | Chivukula et al. | |
| 2010/0217607 | A1 * | 8/2010 | Neuendorf et al. | 704/500 |
| 2010/0228542 | A1 * | 9/2010 | Zhan | 704/203 |
| 2012/0185257 | A1 * | 7/2012 | Oh et al. | 704/500 |

FOREIGN PATENT DOCUMENTS

| | | | |
|---|---|---|---|
| CN | 101218768 | A | 7/2008 |
| CN | 101325060 | A | 12/2008 |
| CN | 101496098 | A | 7/2009 |
| CN | 101796578 | A | 8/2010 |
| WO | WO2007043376 | A1 | 4/2007 |
| WO | WO 2009/039451 | A2 | 3/2009 |

OTHER PUBLICATIONS

Chinese Office Action dated May 27, 2014 for Application No. 201180056646.6, 5 Pages.

European Search Report dated Oct. 12, 2014 for corresponding European Patent Application No. 11842721.0, 6 pages.

Office Action dated Feb. 3, 2015 from corresponding Chinese Patent Application No. 201180056646.6, 13 pages.

* cited by examiner

FIG. 11b

| | | | | |
|---|---|---|---|---|
| WINDOWED INPUT | $Aw_1$ | $Bw_2$ | $Cw_3$ | $Dw_4$ |
| OUTPUT AFTER MDCT/IMDCT | $Aw_1$ $-Bw_{2R}$ | $-Aw_{1R}$ $+Bw_2$ | $Cw_3$ $+Dw_{4R}w_3$ | $-Cw_3$ $+Dw_{4R}$ |
| WINDOWED OUTPUT | $Aw_1w_1$ $-Bw_{2R}w_1$ | $-Aw_{1R}w_2$ $+Bw_2w_2$ | $Cw_3w_3$ $+Dw_{4R}w_3$ | $-Cw_3w_4$ $+Dw_{4R}w_4$ |

| | | | | |
|---|---|---|---|---|
| $Cw_1$ | $Dw_2$ | $Dw_3$ | $Dw_4$ | WINDOWED INPUT |
| $Cw_1$ $-Dw_{2R}$ | $-Cw_{1R}$ $+Dw_2$ | $Dw_3$ $+Dw_{4R}$ | $-Dw_3$ $+Dw_{4R}$ | OUTPUT AFTER MDCT/IMDCT |
| $Cw_1w_1$ $-Dw_{2R}w_1$ | $-Cw_{1R}w_2$ $+Dw_2w_2$ | $Dw_3w_3$ $+Dw_{4R}w_3$ | $-Dw_3w_4$ $+Dw_{4R}w_4$ | WINDOWED OUTPUT |
| C | D | FINAL OVERLAP-ADDITION OUTPUT | | |

FIG. 12b

| | | | | |
|---|---|---|---|---|
| WINDOWED INPUT | $C1w_1$ | $C2w_2$ | $C1w_3$ | $C2w_4$ |
| OUTPUT AFTER MDCT/IMDCT | $C1w_1$ $-C2w_{2R}$ | $-C1w_{1R}$ $+C2w_2$ | $C1w_3$ $+C2w_{4R}$ | $-C1w_3$ $+C2w_{4R}$ |
| WINDOWED OUTPUT | $C1w_1w_1$ $-C2w_{2R}w_1$ | $-C1w_{1R}w_2$ $+C2w_2w_2$ | $C1w_3w_3$ $+C2w_{4R}w_3$ | $-C1w_3w_4$ $+C2w_{4R}w_4$ |

| | | | | |
|---|---|---|---|---|
| $C1w_1$ | $C2w_2$ | $D1w_3$ | $D2w_4$ | WINDOWED INPUT |
| $C1w_1$ $-C2w_{2R}$ | $-C1w_{1R}$ $+C2w_2$ | $D1w_3$ $+D2w_{4R}$ | $-D1w_3$ $+D2w_{4R}$ | OUTPUT AFTER MDCT/IMDCT |
| $C1w_1w_1$ $-C2w_{2R}w_1$ | $-C1w_{1R}w_2$ $+C2w_2w_2$ | $D1w_3w_3$ $+D2w_{4R}w_3$ | $-D1w_3w_4$ $+D2w_{4R}w_4$ | WINDOWED OUTPUT |
| C1 | C2 | FINAL OVERLAP-ADDITION OUTPUT | | |

FIG. 12c

| | | | | |
|---|---|---|---|---|
| WINDOWED INPUT | $C1w_1$ | $C2w_2$ | $D1w_3$ | $D2w_4$ |
| OUTPUT AFTER MDCT/IMDCT | $C1w_1$ $-C2w_{2R}$ | $-C1w_{1R}$ $+C2w_2$ | $D1w_3$ $+D2w_{4R}$ | $-D1w_3$ $+D2w_{4R}$ |
| WINDOWED OUTPUT | $C1w_1w_1$ $-C2w_{2R}w_1$ | $-C1w_{1R}w_2$ $+C2w_2w_2$ | $D1w_3w_3$ $+D2w_{4R}w_3$ | $-D1w_3w_4$ $+D2w_{4R}w_4$ |

| | | | | |
|---|---|---|---|---|
| $D1w_1$ | $D2w_2$ | $D1w_3$ | $D2w_4$ | WINDOWED INPUT |
| $D1w_1$ $-D2w_{2R}$ | $-D1w_{1R}$ $+D2w_2$ | $D1w_3$ $+D2w_{4R}$ | $-D1w_3$ $+D2w_{4R}$ | OUTPUT AFTER MDCT/IMDCT |
| $D1w_1w_1$ $-D2w_{2R}w_1$ | $-D1w_{1R}w_2$ $+D2w_2w_2$ | $D1w_3w_3$ $+D2w_{4R}w_3$ | $-D1w_3w_4$ $+D2w_{4R}w_4$ | WINDOWED OUTPUT |
| D1 | D2 | FINAL OVERLAP-ADDITION OUTPUT | | |

FIG. 14b

| | | | | |
|---|---|---|---|---|
| WINDOWED INPUT | $Cw_1$ | $Cw_2$ | $Cw_3$ | $Dw_4$ |
| OUTPUT AFTER MDCT/IMDCT | $Cw_1$ $-Cw_{2R}$ | $-Cw_{1R}$ $+Cw_2$ | $Cw_3$ $+Dw_{4R}$ | $-Cw_3$ $+Dw_{4R}$ |
| WINDOWED OUTPUT | $Cw_1w_1$ $-Cw_{2R}w_1$ | $-Cw_{1R}w_2$ $+Cw_2w_2$ | $Cw_3w_3$ $+Cw_{4R}w_3$ | $-Cw_3w_4$ $+Dw_{4R}w_4$ |

| | | | | |
|---|---|---|---|---|
| $Cw_1$ | $Dw_2$ | $Dw_3$ | $Dw_4$ | WINDOWED INPUT |
| $Cw_1$ $-Dw_{2R}$ | $-Cw_{1R}$ $+Dw_2$ | $Dw_3$ $+Dw_{4R}$ | $-Dw_3$ $+Dw_{4R}$ | OUTPUT AFTER MDCT/IMDCT |
| $Cw_1w_1$ $-Dw_{2R}w_1$ | $-Cw_{1R}w_2$ $+Dw_2w_2$ | $Dw_3w_3$ $+Dw_{4R}w_3$ | $-Dw_3w_4$ $+Dw_{4R}w_4$ | WINDOWED OUTPUT |
| C | D | FINAL OVERLAP-ADDITION OUTPUT | | |

SPEECH SIGNAL ENCODING METHOD AND SPEECH SIGNAL DECODING METHOD

CROSS REFERENCE TO RELATED APPLICATIONS

This application is a U.S. National Phase Application under 35 U.S.C. §371 of International Application PCT/KR2011/008981, filed on Nov. 23, 2011, which claims the benefit of U.S. Provisional Application No. 61/417,214, filed Nov. 24, 2010 and U.S. Provisional Application No. 61/531,582, filed on Sep. 6, 2011, the entire contents of which are hereby incorporated by reference in their entireties.

TECHNICAL FIELD

The present invention relates to a speech signal encoding method and a speech signal decoding method, and more particularly, to methods of frequency-transforming and processing a speech signal.

BACKGROUND ART

In general, audio signals include signals of various frequencies, the human audible frequency ranges from 20 Hz to 20 kHz, and human voices are present in a range of about 200 Hz to 3 kHz. An input audio signal may include components of a high-frequency zone higher than 7 kHz at which human voices are hardly present in addition to a band in which human voices are present. In this way, when a coding method suitable for a narrowband (up to about 4 kHz) is applied to wideband signals or super-wideband signals, there is a problem in that sound quality degrades.

With a recent increase in demands for video calls, video conferences, and the like, techniques of encoding/decoding audio signals, that is, speech signals, so as to be close to actual voices have increasingly attracted attention.

Frequency transform which is one of methods used to encode/decode a speech signal is a method of causing an encoder to frequency-transform a speech signal, transmitting transform coefficients to a decoder, and causing the decoder to inversely frequency-transform the transform coefficients to reconstruct the speech signal.

In the techniques of encoding/decoding a speech signal, a method of encoding predetermined signals in the frequency domain is considered to be superior, but a time delay may occur when transform for encoding a speech signal in the frequency domain is used.

Therefore, there is a need for a method which can prevent the time delay in encoding/decoding a signal and increase a processing rate.

SUMMARY OF INVENTION

Technical Problem

An object of the invention is to provide a method and a device which can effectively perform MDCT/IMDCT in the course of encoding/decoding a speech signal.

Another object of the invention is to provide a method and a device which can prevent an unnecessary delay from occurring in performing MDCT/IMDCT.

Another object of the invention is to provide a method and a device which can prevent a delay by not using a look-ahead sample to perform MDCT/IMDCT.

Another object of the invention is to provide a method and a device which can reduce a processing delay by reducing an overlap-addition section necessary for perfectly reconstructing a signal in performing MDCT/IMDCT.

Technical Solution (1) According to an aspect of the invention, there is provided a speech signal encoding method including the steps of: specifying an analysis frame in an input signal; generating a modified input based on the analysis frame; applying a window to the modified input; generating a transform coefficient by performing an MDCT (Modified Discrete Cosine Transform) on the modified input to which the window has been applied; and encoding the transform coefficient, wherein the modified input includes the analysis frame and a self replication of all or a part of the analysis frame.

(2) In the speech signal encoding method according to (1), a current frame may have a length of N and the window may have a length of 2N, the step of applying the window may include generating a first modified input by applying the window to the front end of the modified input and generating a second modified input by applying the window to the rear end of the modified input, the step of generating the transform coefficient may include generating a first transform coefficient by performing an MDCT on the first modified input and generating a second transform coefficient by performing an MDCT on the second modified input, and the step of encoding the transform coefficient may include encoding the first modified coefficient and the second modified coefficient.

(3) In the speech signal encoding method according to (2), the analysis frame may include a current frame and a previous frame of the current frame, and the modified input may be configured by adding a self-replication of the second half of the current frame to the analysis frame.

(4) In the speech signal encoding method according to (2), the analysis frame may include a current frame, the modified input may be generated by adding M self-replications of the first half of the current frame to the front end of the analysis frame and adding M self-replications of the second half of the current frame to the rear end of the analysis frame, and the modified input may have a length of 3N.

(5) In the speech signal encoding method according to (1), the window may have the same length as a current frame, the analysis frame may include the current frame, the modified input may be generated by adding a self-replication of the first half of the current frame to the front end of the analysis frame and adding a self-replication of the second half of the current frame to the rear end of the analysis frame, the step of applying the window may include generating first to third modified inputs by applying the window to the modified input while sequentially shifting the window by a half frame from the front end of the modified input, the step of generating the transform coefficient may include generating first to third transform coefficients by performing an MDCT on the first to third modified inputs, and the step of encoding the transform coefficient may include encoding the first to third transform coefficients.

(6) In the speech signal encoding method according to (1), a current frame may have a length of N, the window may have a length of N/2, and the modified input may have a length of 3N/2, the step of applying the window may include generating first to fifth modified inputs by applying the window to the modified input while sequentially shifting the window by a quarter frame from the front end of the modified input, the step of generating the transform coefficient may include generating first to fifth transform coefficients by performing an MDCT on the first to fifth modified inputs, and the step of encoding the transform coefficient may include encoding the first to fifth transform coefficients.

(7) In the speech signal encoding method according to (6), the analysis frame may include the current frame, and the modified input may be generated by adding a self-replication of the front half of the first half of the current frame to the front end of the analysis frame and adding a self-replication of the rear half of the second half of the current frame to the rear end of the analysis frame.

(8) In the speech signal encoding method according to (6), the analysis frame may include the current frame and a previous frame of the current frame, and the modified input may be generated by adding a self-replication of the second half of the current frame to the analysis frame.

(9) In the speech signal encoding method according to (1), a current frame may have a length of N, the window may have a length of 2N, and the analysis frame may include the current frame, and the modified input may be generated by adding a self-replication of the current frame to the analysis frame.

(10) In the speech signal encoding method according to (1), a current frame may have a length of N and the window may have a length of N+M, the analysis frame may be specified by applying a symmetric first window having a slope part with a length of M to the first half with a length of M of the current frame and a subsequent frame of the current frame, the modified input may be generated by self-replicating the analysis frame, and the step of applying the window may include generating a first modified input by applying the second window to the front end of the modified input and generating a second modified input by applying the second window to the rear end of the modified input.

The step of generating the transform coefficient may include generating a first transform coefficient by performing an MDCT on the first modified input and generating a second transform coefficient by performing an MDCT on the second modified input, and the step of encoding the transform coefficient may include encoding the first modified coefficient and the second modified coefficient.

(11) According to another aspect of the invention, there is provided a speech signal decoding method including the steps of generating a transform coefficient sequence by decoding an input signal; generating a temporal coefficient sequence by performing an IMDCT (Inverse Modified Discrete Cosine Transform) on the transform coefficients; applying a predetermined window to the temporal coefficient sequence; and outputting a sample reconstructed by causing the temporal coefficient sequence having the window applied thereto to overlap, wherein the input signal is encoded transform coefficients which are generated by applying same window as the window to a modified input generated based on a predetermined analysis frame in a speech signal and performing an MDCT thereto, and the modified input includes the analysis frame and a self-replication of all or a part of the analysis frame.

(12) In the speech signal decoding method according to (11), the step of generating the transform coefficient sequence may include generating a first transform coefficient sequence and a second transform coefficient sequence of a current frame, the step of generating the temporal coefficient sequence may include generating a first temporal coefficient sequence and a second temporal coefficient sequence by performing an IMDCT on the first transform coefficient sequence and the second transform coefficient sequence, the step of applying the window may include applying the window to the first temporal coefficient sequence and the second temporal coefficient sequence, and the step of outputting the sample may include overlap-adding the first temporal coefficient sequence and the second temporal coefficient sequence having the window applied thereto with a gap of one frame.

(13) In the speech signal decoding method according to (11), the step of generating the transform coefficient sequence may include generating first to third transform coefficient sequences of a current frame.

The step of generating the temporal coefficient sequence may include generating first to third temporal coefficient sequences by performing an IMDCT on the first to third transform coefficient sequences, the step of applying the window may include applying the window to the first to third temporal coefficient sequences, and the step of outputting the sample may include overlap-adding the first to third temporal coefficient sequences having the window applied thereto with a gap of a half frame from a previous or subsequent frame.

(14) In the speech signal decoding method according to (11), the step of generating the transform coefficient sequence may include generating first to fifth transform coefficient sequences of a current frame.

The step of generating the temporal coefficient sequence may include generating first to fifth temporal coefficient sequences by performing an IMDCT on the first to fifth transform coefficient sequences, the step of applying the window may include applying the window to the first to fifth temporal coefficient sequences, and the step of outputting the sample may include overlap-adding the first to fifth temporal coefficient sequences having the window applied thereto with a gap of a quarter frame from a previous or subsequent frame.

(15) In the speech signal decoding method according to (11), the analysis frame may include a current frame, the modified input may be generated by adding a self-replication of the analysis frame to the analysis frame, and the step of outputting the sample may include overlap-adding the first half of the temporal coefficient sequence and the second half of the temporal coefficient sequence.

(16) In the speech signal decoding method according to (11), a current frame may have a length of N and the window is a first window having a length of N+M, the analysis frame may be specified by applying a symmetric second window having a slope part with a length of M to the first half with a length of M of the current frame and a subsequent frame of the current frame, the modified input may be generated by self-replicating the analysis frame, and the step of outputting the sample may include overlap-adding the first half of the temporal coefficient sequence and the second half of the temporal coefficient sequence and then overlap-adding the overlap-added first and second halves of the temporal coefficient to the reconstructed sample of a previous frame of the current frame.

Advantageous Effects

According to the aspects of the invention, it is possible to effectively perform MDCT/IMDCT in the course of encoding/decoding a speech signal.

According to the aspects of the invention, it is possible to prevent an unnecessary delay from occurring in course of performing MDCT/IMDCT.

According to the aspects of the invention, it is possible to prevent a delay by performing MDCT/IMDCT without using a look-ahead sample.

According to the aspects of the invention, it is possible to reduce a processing delay by reducing an overlap-addition section necessary for perfectly reconstructing a signal in the course of performing MDCT/IMDCT.

According to the aspects of the invention, since the delay in a high-performance audio encoder can be reduced, it is possible to use MDCT/IMDCT in bidirectional communications.

According to the aspects of the invention, it is possible to use MDCT/IMDCT techniques in a speech codec that processes high sound quality without any additional delay.

According to the aspects of the invention, it is possible to reduce a delay associated in the MDCT in the existing encoder and to reduce a processing delay in a codec without modifying/changing other configurations.

BRIEF DESCRIPTION OF THE DRAWINGS

FIGS. 11A and 11B are diagrams schematically illustrating an example where a current frame is subjected to an MDCT/IMDCT and is reconstructed by applying a window of 2N in a system according to the invention.

FIGS. 12A to 12C are diagrams schematically illustrating an example where a current frame is subjected to an MDCT/IMDCT and is reconstructed by applying a window of N in a system according to the invention.

FIGS. 14A and 14B are diagrams schematically illustrating another example where a current frame is subjected to an MDCT/IMDCT and is reconstructed by applying a window of 2N in a system according to the invention.

MODE FOR INVENTION

Hereinafter, embodiments of the invention will be specifically described with reference to the accompanying drawings. When it is determined that detailed description of known configurations or functions involved in the invention makes the gist of the invention obscure, the detailed description thereof will not be made.

If it is mentioned that an element is "connected to" or "coupled to" another element, it should be understood that still another element may be interposed therebetween, as well as that the element may be connected or coupled directly to another element.

Terms such as "first" and "second" can be used to describe various elements, but the elements are not limited to the terms. The terms are used only to distinguish one element from another element.

The constituent units described in the embodiments of the invention are independently shown to represent different distinctive functions. Each constituent unit is not constructed by an independent hardware or software unit. That is, the constituent units are independently arranged for the purpose of convenience for explanation and at least two constituent units may be combined into a single constituent unit or a single constituent unit may be divided into plural constituent units to perform functions.

On the other hand, various codec techniques are used to encode/decode a speech signal. Each codec technique may have characteristics suitable for a predetermined speech signal and may be optimized for the corresponding speech signal.

Examples of the codec using an MDCT (Modified Discrete Cosine Transform) includes AAC series of MPEG, G.722.1, G929.1, G718, G711.1, G722 SWB, G.729.1/G718 SWB (Super Wide Band), and G.722 SWB. These codecs are based on a perceptual coding method of performing an encoding operation by combining a filter bank to which the MDCT is applied and a psychoacoustic model. The MDCT is widely used in speech codecs, because it has a merit that a time-domain signal can be effectively reconstructed using an overlap-addition method.

As described above, various codecs using the MDCT are used and the codecs may have different structures to achieve effects to be realized.

For example, the ACC series of MPEG performs an encoding operation by combining an MDCT (filter bank) and a psychoacoustic model, and an ACC-ELD thereof performs an encoding operation using an MDCT (filter bank) with a low delay.

G722.1 applies the MCDT to the entire band and quantizes coefficients thereof G.718 WB (Wide Band) performs an encoding operation into an MDCT-based enhanced layer using a quantization error of a basic core as an input with a layered wideband (WB) codec and a layered super-wideband (SWB) codec.

In addition, EVRC (Enhanced Variable Rate Codec)-WB, G729.1, G.718, G711.1, G.718/G729.1 SWB, and the like performs an encoding operation into a MDCT-based enhanced layer using a band-divided signal as an input with a layered wideband codec and a layered super-wideband codec.

Figure 1:
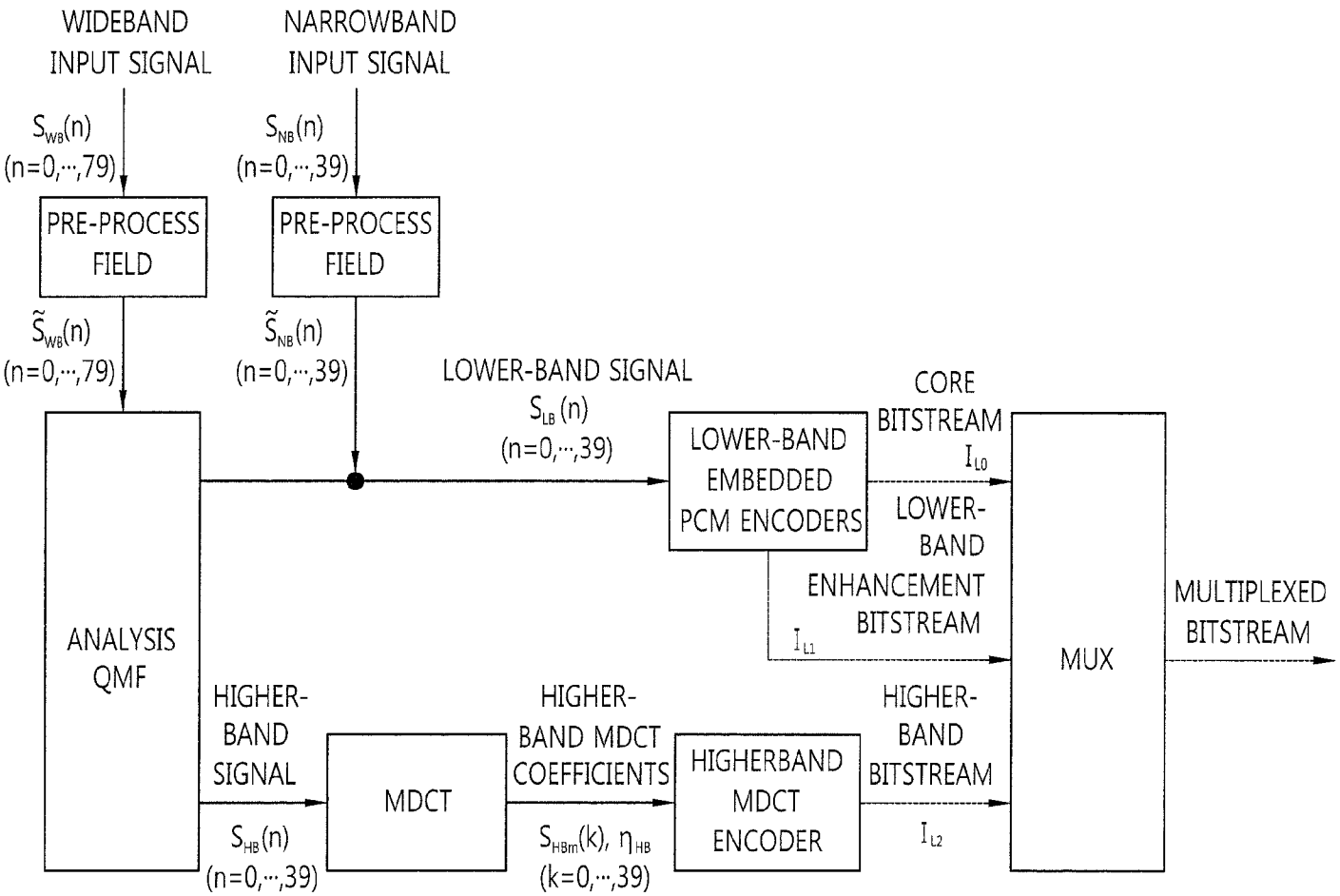
FIG. 1 is a diagram illustrating an example where an encoder encoding a speech signal uses an MDCT, where the configuration of G.711 WB is schematically illustrated.

FIG. 1 is a diagram schematically illustrating the configuration of G711 WB in an example where an encoder used to encode a speech signal uses an MDCT.

Referring to FIG. 1, an MDCT unit of G.711 WB receives a higher-band signal as an input, performs an MDCT thereon, and outputs coefficients thereof. An MDCT encoder encodes MDCT coefficients and outputs a bitstream.

Figure 2:
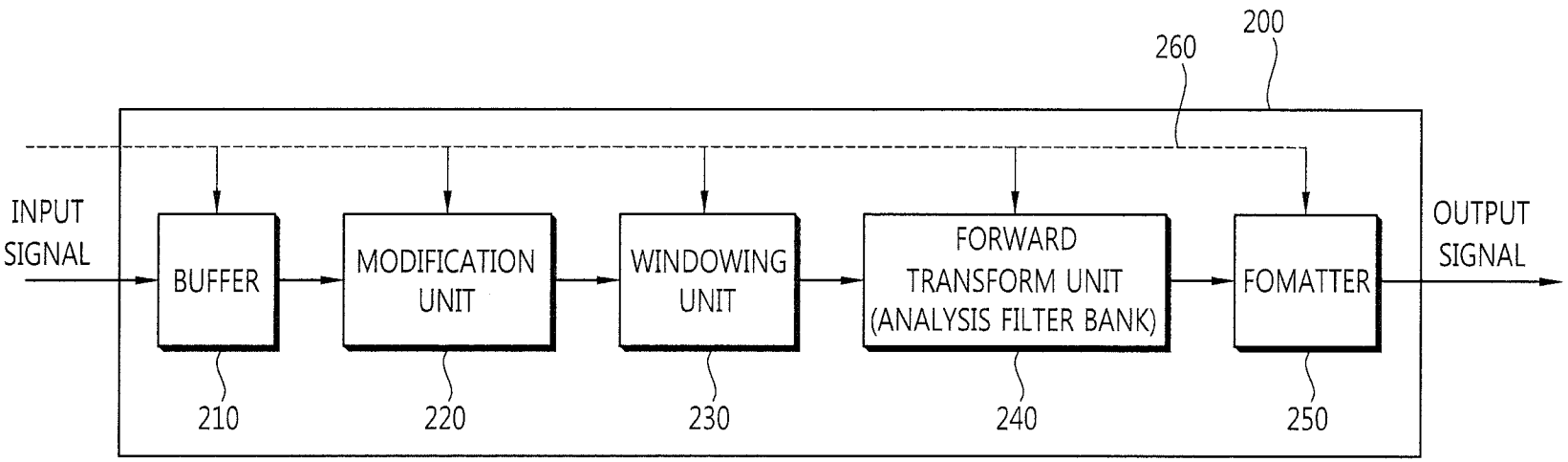
FIG. 2 is a block diagram schematically illustrating an MDCT unit of an encoder in a speech signal/encoding/decoding system according to the invention.

FIG. 2 is a block diagram schematically illustrating an MDCT unit of an encoder in a speech signal encoding/decoding system according to the invention.

Referring to FIG. 2, an MDCT unit 200 of the encoder performs an MDCT on an input signal and outputs the resultant signal. The MDCT unit 200 includes a buffer 210, a modification unit 220, a windowing unit 230, a forward transform unit 240, and a formatter 250. Here, the forward transform unit 240 is also referred to as an analysis filter bank as shown in the drawing.

Side information on a signal length, a window type, bit assignment, and the like can be transmitted to the units 210 to 250 of the MDCT unit 200 via a secondary path 260. It is described herein that the side information necessary for the operations of the units 210 to 250 can be transmitted via the secondary path 260, but this is intended only for convenience for explanation and necessary information along with a signal may be sequentially transmitted to the buffer 210, the modification unit 220, the windowing unit 230, the forward transform unit 240, and the formatter 250 in accordance with the order of operations of the units shown in the drawing without using a particular secondary path.

The buffer 210 receives time-domain samples as an input and generates a signal block on which processes such as the MDCT are performed.

The modification unit 220 modifies the signal block received from the buffer 210 so as to be suitable for the processes such as the MDCT and generates a modified input signal. At this time, the modification unit 220 may receives the side information necessary for modifying the signal block and generating the modified input signal via the secondary path 260.

The windowing unit 230 windows the modified input signal. The windowing unit 230 can window the modified input signal using a trapezoidal window, a sinusoidal window, a Kaiser-Bessel Driven window, and the like. The windowing unit 230 may receive the side information necessary for windowing via the secondary path 260.

The forward transform unit 240 applies the MDCT to the modified input signal. Therefore, the time-domain signal is transformed to a frequency-domain signal and the forward transform unit 240 can extract spectral information from frequency-domain coefficients. The forward transform unit 240 may also receive the side information necessary for transform via the secondary path 260.

The formatter 250 formats information so as to be suitable for transmission and storage. The formatter 250 generates a digital information block including the spectral information extracted by the forward transform unit 240. The formatter 250 can pack quantization bits of a psychoacoustic model in the course of generating the information block. The formatter 250 can generate the information block in a format suitable for transmission and storage and can signal the information block. The formatter 250 may receive the side information necessary for formatting via the secondary path 260.

Figure 3:
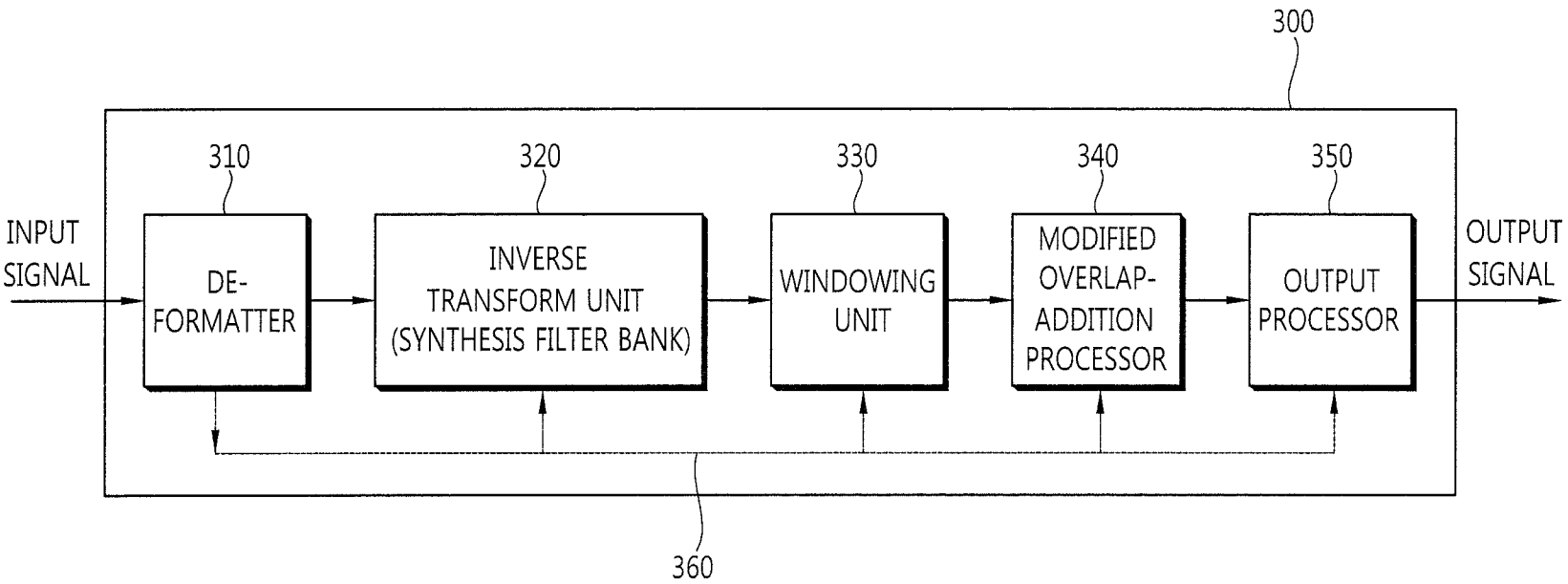
FIG. 3 is a block diagram schematically illustrating an IMDCT (Inverse MDCT) unit of a decoder in a speech signal/encoding/decoding system according to the invention.

FIG. 3 is a block diagram schematically illustrating an IMDCT (Inverse MDCT) of a decoder in the speech signal encoding/decoding system according to the invention.

Referring to FIG. 3, an IMDCT unit 300 of the decoder includes a de-formatter 310, an inverse transform (or backward transform) unit 320, a windowing unit 330, a modified overlap-addition processor 340, an output processor 350.

The de-formatter 310 unpacks information transmitted from an encoder. By this unpacking, the side information on an input signal length, an applied window type, bit assignment, and the like can be extracted along with the spectral information. The unpacked side information can be transmitted to the units 310 to 350 of the MDCT unit 300 via a secondary path 360.

It is described herein that the side information necessary for the operations of the units 310 to 350 can be transmitted via the secondary path 360, but this is intended only for convenience for explanation and the necessary side information may be sequentially transmitted to the de-formatter 310, the inverse transform unit 320, the windowing unit 330, the modified overlap-addition processor 340, and the output processor 350 in accordance with the order of processing the spectral information without using a particular secondary path.

The inverse transform unit 320 generates frequency-domain coefficients from the extracted spectral information and inversely transforms the generated frequency-domain coefficients. The inverse transform may be performed depending on the transform method used in the encoder. When the MDCT is applied in the encoder, the inverse transform unit 320 can apply an IMDCT (Inverse MDCT) to the frequency-domain coefficients. The inverse transform unit 320 can perform an inverse transform operation, that is, can transform the frequency-domain coefficients into time-domain signals (for example, time-domain coefficients), for example, through the IMDCT. The inverse transform unit 320 may receive the side information necessary for the inverse transform via the secondary path 360.

The windowing unit 330 applies the same window as applied in the encoder to the time-domain signal (for example, the time-domain coefficients) generated through the inverse transform. The windowing unit 330 may receive the side information necessary for the windowing via the secondary path 360.

The modified overlap-addition processor 340 overlaps and adds the windowed time-domain coefficients (the time-domain signal) and reconstructs a speech signal. The modified overlap-addition processor 340 may receive the side information necessary for the windowing via the secondary path 360.

The output processor 350 outputs the overlap-added time-domain samples. At this time, the output signal may be a reconstructed speech signal or may be a signal requiring an additional post-process.

On the other hand, in the MDCT/IMDCT performed by the MDCT unit of the encoder and the IMDCT unit of the decoder, the MDCT is defined by Math Figure 1.

⟨Math Figure 1⟩

$$\alpha_r = \sum_{k=0}^{2N-1} \tilde{a}_k \cos\left\{\pi \frac{[k+(N+1)/2](r+1/2)}{N}\right\},$$

$$r = 0, \ldots, N-1$$

$$\hat{a}_k = \frac{2}{N} \sum_{k=0}^{N-1} \alpha_r \cos\left\{\pi \frac{[k+(N+1)/2](r+1/2)}{N}\right\},$$

$$k = 0, \ldots, 2N-1$$

$\tilde{a}_k = a_k \cdot w$ represents a windowed time-domain input signal and w represents a symmetric window function. $\alpha_r$ represents N MDCT coefficients. $\hat{a}_k$ represents a reconstructed time-domain input signal having 2N samples.

In a transform coding method, the MDCT is a process of transforming the time-domain signal into nearly-uncorrelated transform coefficients. In order to achieve a reasonable transmission rate, a long window is applied to a signal of a stationary section and the transform is performed. Accordingly, the volume of the side information can be reduced and a slow-varying signal can be more efficiently encoded. However, in this case, the total delay which occurs in application of the MDCT increases.

In order to prevent the total delay, a distortion due to a pre echo may be located in a temporal masking using a short window instead of the long window so as not to acoustically hear the distortion. However, in this case, the volume of the side information increases and the merit in the transmission rate is cancelled.

Therefore, a method (adaptive window switching) of switching a long window and a short window and adaptively modifying the window of a frame section to which the MDCT is applied can be used. Both a slow-varying signal and a fast-varying signal can be effectively processed using the adaptive window switching.

The specific method of the MDCT will be described below with reference to the accompanying drawings.

The MDCT can effectively reconstruct an original signal by cancelling an aliasing, which occurs in the course of transform, using the overlap-addition method.

As described above, the MDCT (Modified Discrete Cosine Transform) is a transform of transforming a time-domain signal into a frequency-domain signal, and the original signal, that is, the signal before the transform, can be perfectly reconstructed using the overlap-addition method.

Figure 4:
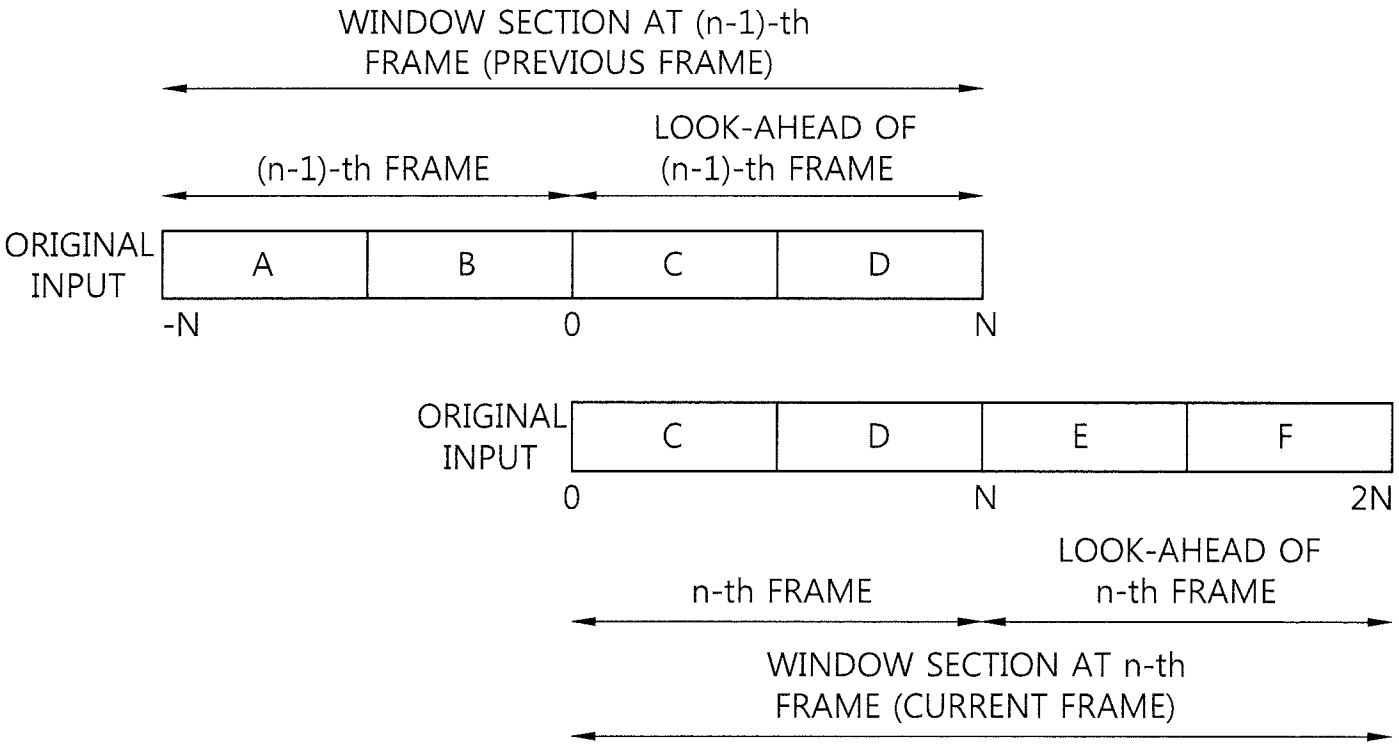
FIG. 4 is a diagram schematically illustrating an example of a frame and an analysis window when an MDCT is applied.

FIG. 4 is a diagram schematically illustrating an example of a frame and an analysis window when an MDCT is applied.

A look-ahead (future) frame of a current frame with a length of N can be used to perform the MDCT on the current frame with a length of N. At this time, an analysis window with a length of 2N can be used for the windowing process.

Referring to FIG. 4, a window with a length of 2N is applied to a current frame (n-th frame) with a length of N and a look-ahead frame of the current frame. A window with a length of 2N can be similarly applied to a previous frame, that is, a (n−1)-th frame, and a look-ahead frame of the (n−1)-th frame.

The length (2N) of the window is set depending on an analysis section. Therefore, in the example shown in FIG. 4, the analysis section is a section with a length of 2N including the current frame and the look-ahead frame of the current frame.

In order to apply the overlap-addition method, a predetermined section of the analysis section is set to overlap with the previous frame or subsequent frame. In the example shown in FIG. 4, a half of the analysis section overlaps with the previous frame.

In order to perform the MDCT on the (n−1)-th frame ("AB" section) with a length of N, a section with a length of 2N ("ABCD" section) including the n-th frame ("CD" section) with a length of N can be reconstructed. A windowing process of applying the analysis window to the reconstructed section is performed.

As for the n-th frame ("CD" section) with a length of N, an analysis section with a length of 2N ("CDEF" section) including the (n+1)-th frame ("EF" section) with a length of N for the MDCT is reconstructed and the window with a length of 2N is applied to the analysis section.

Figure 5:
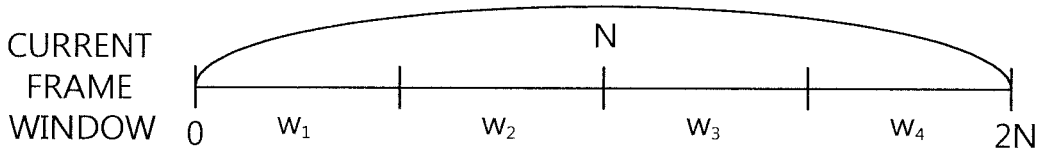
FIG. 5 is a diagram schematically illustrating an example of a window to be applied for an MDCT.

FIG. 5 is a diagram schematically illustrating an example of a window applied for the MDCT.

As described above, by using overlap-addition, the MDCT can perfectly reconstruct a signal before the transform. At this time, the window for windowing a time-domain signal should satisfy the condition of Math Figure 2 so as to perfectly reconstruct a signal before applying the MDCT.

$$\omega 1 = \omega 4R,\ \omega 2 = \omega 3R,\ \omega 1\omega 1 + \omega 3\omega 3 = \omega 2\omega 2 + \omega 4\omega 4 = 1.0 \quad \text{<Math Figure 2>}$$

In Math Figure 2 and FIG. 5, wX (where X is 1, 2, 3, or 4) represents a piece of a window (analysis window) for the analysis section of the current frame and X represents an index when the analysis window is divided into four pieces. R represents a time reversal.

An example of the window satisfying the condition of Math Figure 2 is a symmetric window. Examples of the symmetric window include the trapezoidal window, the sinusoidal window, the Kaiser-Bessel Driven window, and the like. A window having the same shape as used in the encoder is used as a synthesis window used for synthesization in the decoder.

Figure 6:
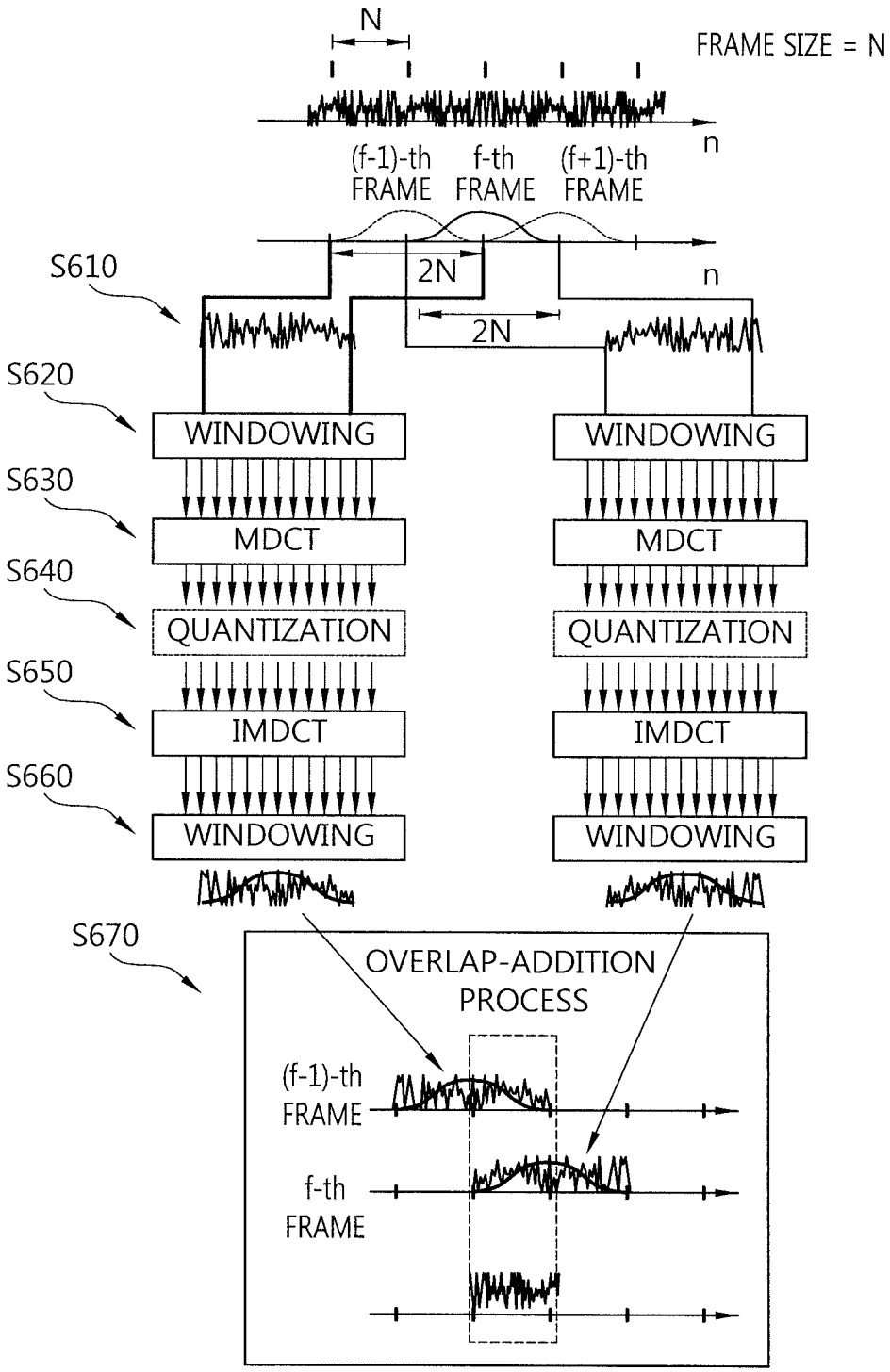
FIG. 6 is a diagram schematically illustrating an overlap-adding process using an MDCT.

FIG. 6 is a diagram schematically illustrating an overlap-addition process using the MDCT.

Referring to FIG. 6, the encoder can set an analysis section with a length of 2N to which the MDCT is applied for the frames with a length of N, that is, a (f−1)-th frame, a f-th frame, and a (f+1)-th frame.

An analysis window with a length of 2N is applied to the analysis section (S610). As shown in the figure, the first or second half of the analysis section to which the analysis window is applied overlaps with the previous or subsequent analysis section. Therefore, the signal before the transform can be perfectly reconstructed through the later overlap-addition.

Subsequently, a time-domain sample with a length of 2N is obtained through the windowing (S620).

The MDCT is applied to the time-domain sample to generate N frequency-domain transform coefficients (S630).

Quantized N frequency-domain transform coefficients are created through quantization (S640).

The frequency-domain transform coefficients are transmitted to the decoder along with the information block or the like.

The decoder obtains the frequency-domain transform coefficients from the information block or the like and generates a time-domain signal with a length of 2N including an aliasing by applying the IMDCT to the obtained frequency-domain transform coefficients (S650).

Subsequently, a window with a length of 2N (a synthesis window) is applied to the time-domain signal with a length of 2N (S660).

An overlap-addition process of adding overlapped sections is performed on the time-domain signal to which the window has been applied (S670). As shown in the drawing, by adding the section with a length of N in which the reconstructed signal with a length of 2N reconstructed in the (f−1)-th frame section and the reconstructed signal with a length of N reconstructed in the f-th frame section overlap with each other, the aliasing can be cancelled and a signal of the frame section before the transform (with a length of N) can be reconstructed.

As described above, the MDCT (Modified Discrete Cosine Transform) is performed by the forward transform unit (analysis filter bank) 240 in the MDCT unit 200 shown in FIG. 2. Here, it is described that the MDCT is performed by the forward transform unit, but this is intended only for convenience for explanation and the invention is not limited to this configuration. The MDCT may be performed by a module for performing the time-frequency domain transform. The MDCT may be performed in step S630 shown in FIG. 6.

Specifically, the result as shown in Math Figure 3 can be obtained by performing the MDCT on an input signal $a_k$ including 2N samples in a frame with a length of 2N.

$$\alpha_r = \sum_{k=0}^{2N-1} \tilde{a}_k \cos\left\{\pi \frac{[k+(N+1)/2](r+1/2)}{N}\right\}, \quad r = 0, \ldots, N-1 \qquad \text{⟨Math Figure 3⟩}$$

In Math Figure 3, $\tilde{a}_k$ represents the windowed input signal, which is obtained by multiplying the input signal $a_k$ by a window function $h_k$.

The MDCT coefficients can be calculated by performing an $SDFT_{(N+1)/2,\ 1/2}$ on the windowed input signal of which the aliasing component is corrected. The SDFT (Sliding Discrete Fourier Transform) is a kind of time-frequency transform method. The SDFT is defined by Math Figure 4.

$$SDFT_{u,v} = \alpha_r^{u,v} = \sum_{k=0}^{2N-1} \alpha_k \exp\left[i2\pi \frac{(k+u)(r+v)}{2N}\right] \qquad \text{⟨Math Figure 4⟩}$$

Here, u represents a predetermined sample shift value and v represents a predetermined frequency shift value. That is, the SDFT is to shift samples of the time axis and the frequency axis, while a DFT is performed in the time domain and the frequency domain. Therefore, the SDFT may be understood as generalization of the DFT.

It can be seen from the comparison of Math Figures 3 and 4 that the MDCT coefficients can be calculated by performing the $SDFT_{(N+1)/2,1/2}$ on the windowed input signal of which the aliasing component is corrected as described above. That is, as can be seen from Math Figure 5, a value of a real part after the windowed signal and the aliasing component are subjected to the $SDFT_{(N+1)/2,\ 1/2}$ is an MDCT coefficient.

$$\alpha_r = \mathrm{real}\{SDFT_{(N+1)/2,1/2}(\tilde{a}_k)\} \qquad \text{<Math Figure 5>}$$

The $SDFT_{(N+1)/2,\ 1/2}$ can be arranged in Math Figure 6 using a general DFT (Discrete Fourier Transform).

$$\sum_{k=0}^{2N-1} \hat{\alpha}_k \exp\left[i2\pi \frac{(k+(N+1)/2)(r+1/2)}{2N}\right] = \left\{\sum_{k=0}^{2N-1}\left[\hat{\alpha}_k \exp\left(i2\pi\frac{k}{4N}\right)\right]\exp\left(i2\pi\frac{kr}{2N}\right)\right\} \times \exp\left[i2\pi\frac{(N+1)r}{4N}\right]\exp\left(i\pi\frac{N+1}{4N}\right) \qquad \text{⟨Math Figure 6⟩}$$

In Math Figure 6, the first exponential function can be said to be the modulation of $\hat{a}_k$. That is, it represents a shift in the frequency domain by half a frequency sampling interval.

In Math Figure 6, the second exponential function is a general DFT. The third exponential function represents a shift in the time domain by (N+1)/2 of a sampling interval. Therefore, the $SDFT_{(N+1)/2,\ 1/2}$ can be said to be a DFT of a signal which is shifted by (N+1)/2 of a sampling interval in the time domain and shifted by half a frequency sampling interval in the frequency domain.

Figure 7:
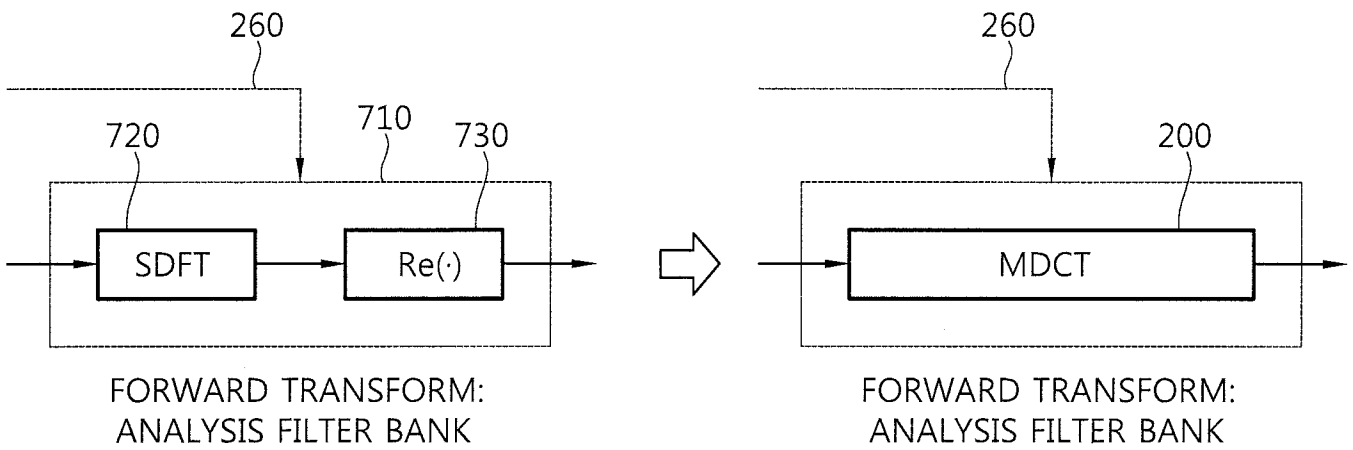
FIG. 7 is a diagram schematically illustrating an MDCT and an SDFT.

As a result, the MDCT coefficient is the value of the real part after the time-domain signal is subjected to the SDFT. The relational expression of the input signal $a_k$ and the MDCT coefficient $\alpha_r$ can be arranged in Math Figure 7 using the SDFT.

$$\alpha_r = \frac{1}{2}\sum_{k=0}^{2N-1} \hat{\alpha}_k \exp\left[i\pi \frac{[k+(N+1)/2](r+1/2)}{N}\right] \qquad \text{⟨Math Figure 7⟩}$$

Figure 8:
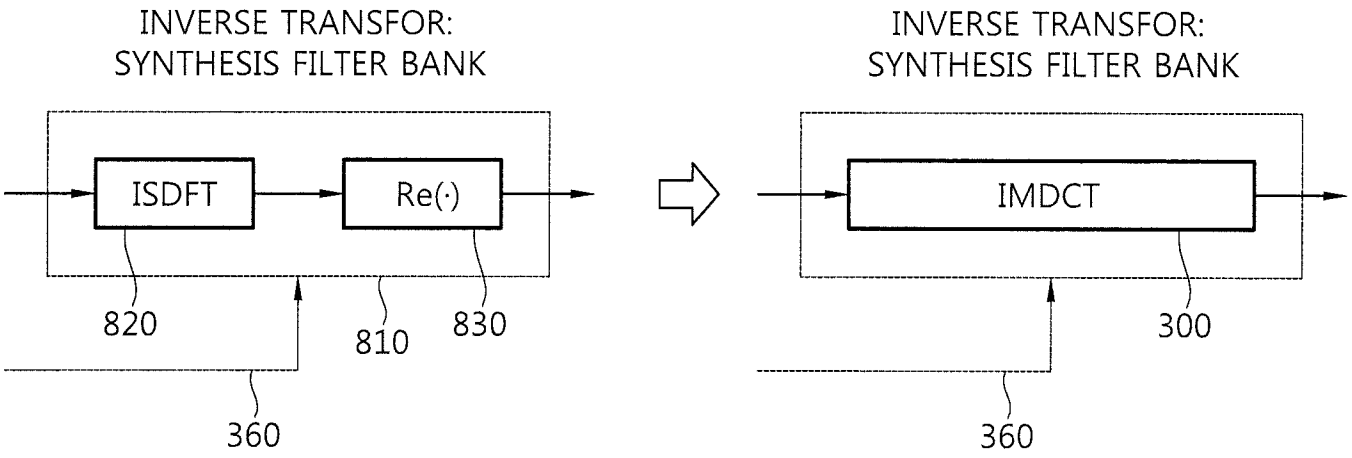
FIG. 8 is a diagram schematically illustrating an IMDCT and an ISDFT.

Here, $\hat{\alpha}_r$ represents a signal obtained by correcting the windowed signal and the aliasing component after the MDCT transform using Math Figure 8.

$$\hat{\alpha}_k = \begin{cases} \frac{1}{2}\tilde{a}_k - \frac{1}{2}\tilde{a}_{N-1-k}, & k = 0, \ldots, N-1 \\ \frac{1}{2}\tilde{a}_k + \frac{1}{2}\tilde{a}_{3N-1-k}, & k = N, \ldots, 2N-1 \end{cases} \qquad \text{⟨Math Figure 8⟩}$$

FIG. 7 is a diagram schematically illustrating the MDCT and the SDFT.

Referring to FIG. 7, an MDCT unit 710 including an SDFT unit 720 that receives side information via a secondary path 260 and that performs an SDFT on the input information and a real part acquiring module 730 that extracts a real part from the SDFT result is an example of the MDCT unit 200 shown in FIG. 2.

On the other hand, the IMDCT (Inverse MDCT) can be performed by the inverse transform unit (analysis filter bank) 320 of the IMDCT unit 300 shown in FIG. 3. Here, it is described that the IMDCT is performed by the inverse transform unit, but this is intended only for convenience for explanation and the invention is not limited to this configuration. The IMDCT may be performed by a module performing the time-frequency domain transform in the decoder. The IMDCT may be performed in step S650 shown in FIG. 6.

Figure 9:
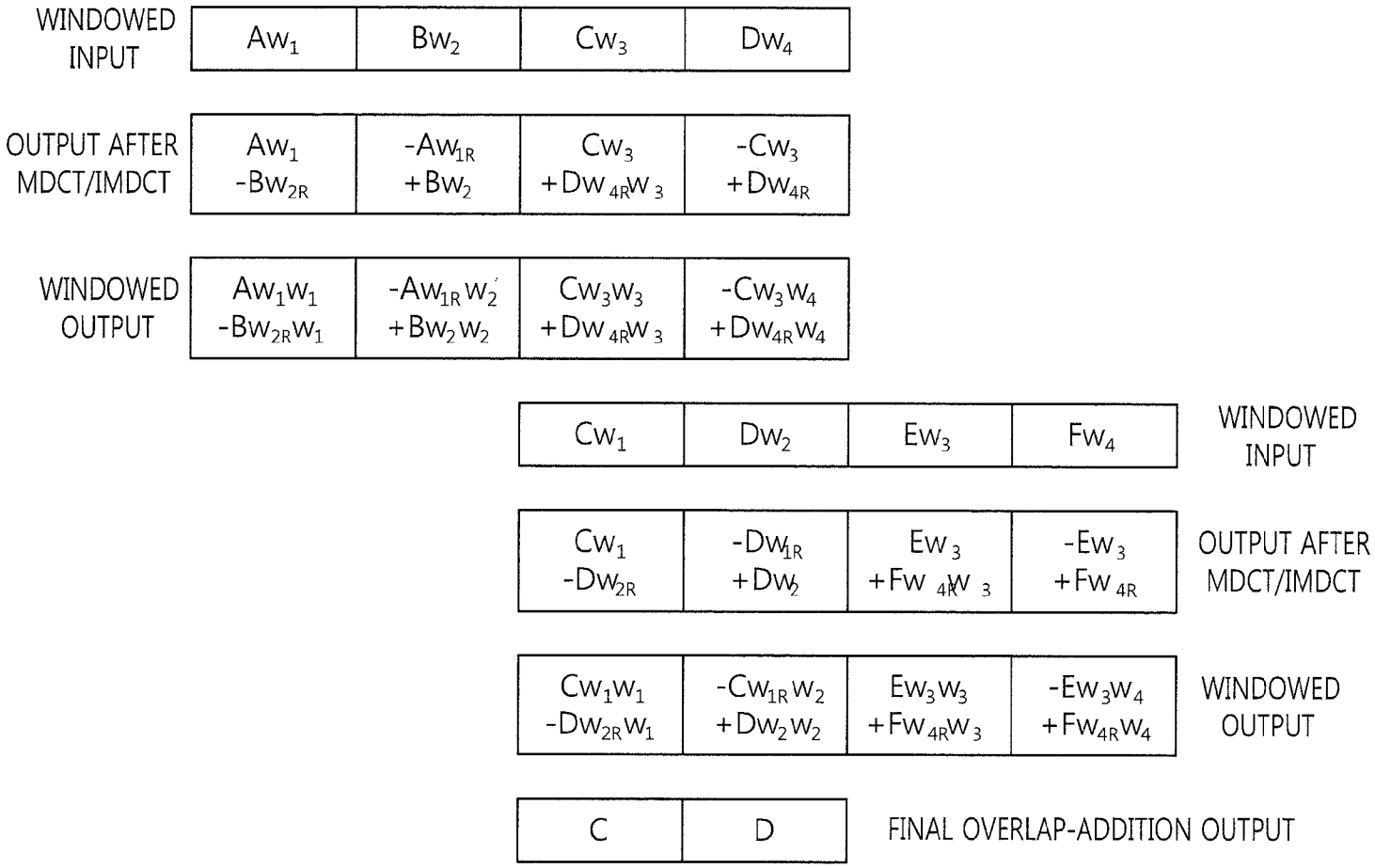
FIG. 9 is a diagram schematically illustrating an example of an analysis-synthesis structure which can be performed for application of an MDCT.

The IMDCT can be defined by Math Figure 9.

$$\hat{a}_r = \frac{2}{N}\sum_{k=0}^{N-1} \alpha_r \cos\left\{\pi \frac{[k+(N+1)/2](r+1/2)}{N}\right\}, \quad k = 0, \ldots, 2N-1 \qquad \text{⟨Math Figure 9⟩}$$

Here, $\alpha_r$ represents the MDCT coefficient and $\hat{a}_k$ represents the IMDCT output signal having 2N samples.

The backward transform, that is, the IMDCT, has an inverse relationship with respect to the forward transform, that is, the MDCT. Therefore, the backward transform is performed using this relationship.

Figure 10:
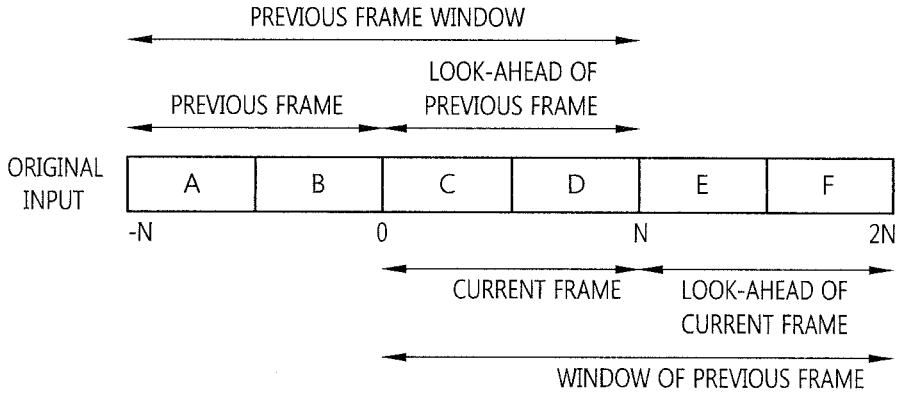
FIG. 10 is a diagram schematically illustrating a frame structure with which a speech signal is input to a system according to the invention.

The time-domain signal can be calculated by performing the ISDFT (Inverse SDFT) on the spectrum coefficients extracted by the de-formatter 310 and then taking the real part thereof as shown in Math Figure 10.

$$ISDFT_{u,v} = a_r^{u,v} = \frac{1}{2N}\sum_{r=0}^{2N-1} \alpha_r^{u,v} \exp\left[-i2\pi \frac{(k+u)(r+v)}{2N}\right] \qquad \text{⟨Math Figure 10⟩}$$

In Math Figure 10, u represents a predetermined sample shift value in the time domain and v represents a predetermined frequency shift value.

FIG. 8 is a diagram schematically illustrating the IMDCT and the ISDFT.

Referring to FIG. 8, an IMDCT unit 810 including an ISDFT unit 820 that receives side information via a secondary path 360 and that performs an ISDFT on the input information and a real part acquiring module 830 that extracts a real part from the ISDFT result is an example of the IMDCT unit 300 shown in FIG. 3.

On the other hand, the IMDCT output signal $\hat{a}_k$ includes an aliasing in the time domain, unlike the original signal. The aliasing included in the IMDCT output signal is the same as expressed by Math Figure 11.

$$\hat{a}_k = \begin{cases} \tilde{a}_k - \tilde{a}_{N-1-k} & k = 0, \ldots, N-1 \\ \tilde{a}_k + \tilde{a}_{3N-1-k} & k = N, \ldots, 2N-1 \end{cases} \quad \langle \text{Math Figure 11} \rangle$$

As described above, when the MDCT is applied, the original signal is not perfectly reconstructed through the inverse transform (IMDCT) due to the aliasing component based on the MDCT and the original signal is perfectly reconstructed through the overlap-addition, unlike the DFT or the DCT. This is because information corresponding to the imaginary part is lost by taking the real part of the $SDFT_{(N+1)/2,\ 1/2}$.

FIG. 9 is a diagram schematically illustrating an example of an analysis-systhesis structure which can be performed in applying the MDCT. In the example shown in FIG. 9, a general example of the analysis-synthesis structure will be described with reference to the examples shown in FIGS. 4 and 5.

In order to reconstruct the "CD" frame section of the original signal, the "AB" frame section which is a previous frame section of the "CD" frame section and the "EF" frame section which is a look-ahead section thereof are necessary. Referring to FIG. 4, an analysis frame "ABCD" including the (n−1)-th frame and the look-ahead frame of the (n−1)-th frame and an analysis frame "CDEF" including the n-th frame and the look-ahead frame of the n-th frame can be constructed.

By applying the window shown in FIG. 5 to the analysis frame "ABCD" and the analysis frame "CDEF", windowed inputs "Aw1 to Dw4" and "Cw1 to Fw4" shown in FIG. 9 can be created.

The encoder applies the MDCT to "Aw1 to Dw4" and "Cw1 to Fw4", and the decoder applies the IMDCT to "Aw1 to Dw4" and "Cw1 to Fw4" to which the MDCT has been applied.

Subsequently, the decoder applies a window to create sections "$Aw_1w_2-Bw_{2R}w_1$, $-Aw_{1R}w_2+Bw_2w_2$, $Cw_3w_3+Dw_{4R}w_3$, and $-Cw_3w_4+Dw_{4R}w_4$" and sections "$Cw_1w_1-Dw_{2R}w_1$, $-Cw_{1R}w_2+Dw_2w_2$, $Ew_3w_3+Fw_{4R}w_3$, and $-Ew_3w_4+Fw_{4R}w_4$".

Then, by overlap-adding and outputting the sections "$Aw_1w_2-Bw_{2R}w_1$, $-Aw_{1R}w_2+Bw_2w_2$, $Cw_3w_3+Dw_{4R}w_3$, and $-Cw_3w_4+Dw_{4R}w_4$" and the sections "$Cw_1w_1-Dw_{2R}w_1$, $-Cw_{1R}w_2+Dw_2w_2$, $Ew_3w_3+Fw_{4R}w_3$, and $-Ew_3w_4+Fw_{4R}w_4$", the "CD" frame section can be reconstructed like the original, as shown in the drawing. In the above-mentioned process, the aliasing component in the time domain and the value of the output signal can be obtained in accordance with the definitions of the MDCT and the IMDCT.

On the other hand, in the course of MDCT/IMDCT transform and overlap-addition, the look-ahead frame is required for perfectly reconstructing the "CD" frame section and thus a delay corresponding to the look-ahead frame occurs. Specifically, in order to perfectly reconstruct the current frame section "CD", "CD" which is a look-ahead frame in processing the previous frame section "AB" is necessary and "EF" which is a look-ahead frame of the current frame is also necessary. Therefore, in order to perfectly reconstruct the current frame "CD", the MDCT/IMDCT output of the "ABCD" section and the MDCT/I MDCT output of the "CDEF" section are necessary, and a structure is obtained in which a delay occurs by the "EF" section corresponding to the look-ahead frame of the current frame "CD".

Therefore, a method can be considered which can prevent the delay occurring due to use of the look-ahead frame and raise the encoding/decoding speed using the MDCT/IMDCT as described above.

Specifically, an analysis frame including the current frame or a part of the analysis frame is self-replicated to create a modified input (hereinafter, referred to as a "modified input" for the purpose of convenience for explanation), a window is applied to the modified input, and then the MDCT/IMDCT can be performed thereon. By applying a window and creating a target section to be subjected to the MDCT/IMDCT through the self-replication of a frame without encoding/decoding the current frame on the basis of the processing result of a previous or subsequent frame, the MDCT/IMDCT can be rapidly performed without a delay to reconstruct a signal.

FIG. 10 is a diagram schematically illustrating a frame structure in which a speech signal is input in the system according to the invention. In general, when an original signal is reconstructed by applying the MDCT/IMDCT and performing the overlap-addition, the previous frame section "AB" of the current frame "CD" and the look-ahead frame "EF" of the current frame "CD" are necessary and the look-ahead frame should be processed to reconstruct the current frame as described above. Accordingly, a delay corresponding to the look-ahead frame occurs.

In the invention, as described above, an input (block) to which a window is applied is created by self-replicating the current frame "CD" or self-replicating a partial section of the current frame "CD". Therefore, since it is not necessary to process a look-ahead frame so as to reconstruct the signal of the current frame, a delay necessary for processing a look-ahead frame does not occur.

Hereinafter, embodiments of the invention will be described in detail with reference to the accompanying drawings.

Embodiment 1

Figure 11A:
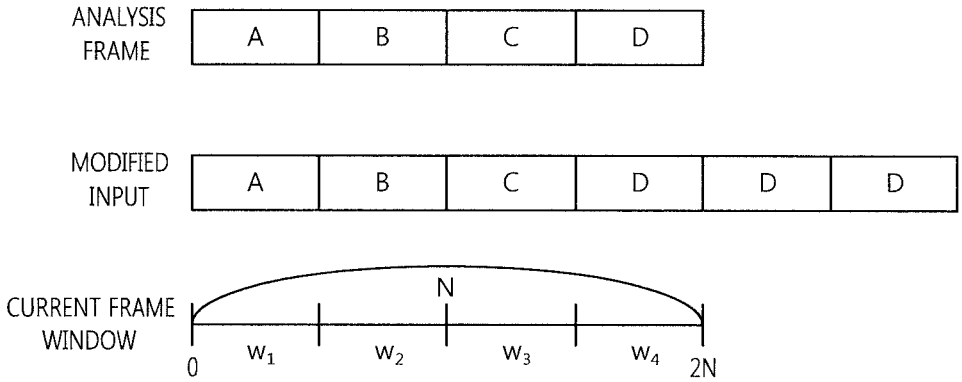

FIGS. 11A and 11B are diagrams schematically illustrating an example where a current frame is processed and reconstructed by MDCT/IMDCT by applying a window with a length of 2N in the system according to the invention.

In the examples shown in FIGS. 11A and 11B, an analysis frame with a length of 2N is used. Referring to FIG. 11A, the encoder replicates a section "D" which is a part (sub-frame) of a current frame "CD" in the analysis frame "ABCD" with a length of 2N and creates a modified input "ABCDDD". In consideration of the fact that this analysis frame is modified, the modified input may be considered as a "modified analysis frame" section.

The encoder applies a window (current frame window) for reconstructing the current frame to the front section "ABCD" and the rear section "CDDD" of the modified input "ABCDDD".

As shown in the drawing, the current frame window has a length of 2N to correspond to the length of the analysis frame and includes four sections corresponding to the length of the sub-frame.

The current frame window with a length of 2N used to perform the MDCT/IMDCT includes four sections each corresponding to the length of the sub-frame.

Referring to FIG. 11B, the encoder creates an input "$Aw_1$, $Bw_2$, $Cw_3$, $Dw_4$" obtained by applying the window to the front section of the modified input and an input "$Cw_1$, $Dw_2$, $Dw_3$, $Dw_4$" obtained by applying the window to the rear section of the modified input and applies the MDCT to the created two inputs.

The encoder transmits the encoded information to the decoder after applying the MDCT to the inputs. The decoder obtains the inputs to which the MDCT has been applied from the received information and applies the obtained inputs.

The MDCT/IMDCT result shown in the drawing can be obtained by processing the inputs to which the window has been applied on the basis of the above-mentioned definitions of MDCT and IMDCT.

The decoder creates outputs to which the same window as applied in the encoder is applied after applying the IMDCT. As shown in the drawing, the decoder can finally reconstruct the signal of the "CD" section by overlap-adding the created two outputs. At this time, the signal other than the "CD" section is cancelled by applying the condition (Math Figure 2) necessary for perfect reconstruction as described above.

Embodiment 2

Figure 12A:
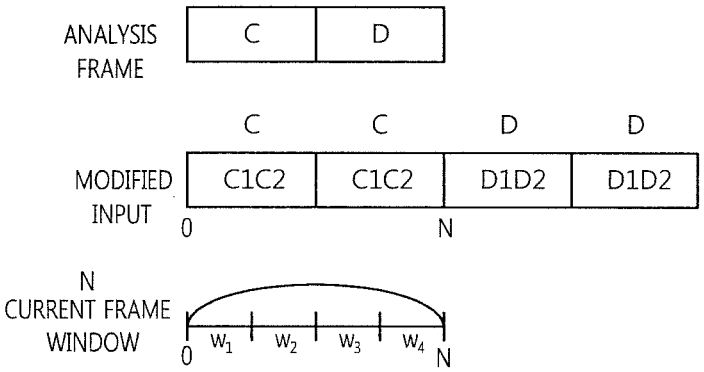

FIGS. 12A to 12C are diagrams schematically illustrating an example where a current frame is processed and reconstructed by MDCT/IMDCT by applying a window with a length of N in the system according to the invention.

In the examples shown in FIGS. 12A to 12C, an analysis frame with a length of N is used. Therefore, in the examples shown in FIGS. 12A to 12C, the current frame can be used as the analysis frame.

Referring to FIG. 12A, the encoder replicates sections "C" and "D" in the analysis frame "CD" with a length of N and creates a modified input "CCDD". At this time, the sub-frame section "C" includes sub-sections "C1" and "C2" as shown in the drawing, and the sub-frame section "D" includes sub-sections "D1" and "D2" as shown in the drawing. Therefore, the modified input can be said to include "C1C2C1C2D1D2D1D2".

The current frame window with a length of N used to perform the MDCT/IMDCT includes four sections each corresponding to the length of the sub-frame.

The encoder applies the current frame window with a length of N to the front section "CC", that is, "C1C2", of the front section "CC" of the modified input "CCDD", applies the current frame window to the intermediate section "CD", that is, "C1C2D1D2", and performs the MDCT/IMDCT thereon. The encoder applies the current frame window with a length of N to the intermediate section "CD", that is, "C1C2D1D2", of the front section "CC" of the modified input "CCDD", applies the current frame window to the rear section "DD", that is, "D1D2D1D2", and performs the MDCT/IMDCT thereon.

FIG. 12B is a diagram schematically illustrating an example where the MDCT/IMDCT is performed on the front section and the intermediate section of the modified input. Referring to FIG. 12B, the encoder creates an input "C1$w_1$, C2$w_2$, C1$w_3$, C2$w_4$" obtained by applying the window to the front section of the modified input and an input "C1$w_1$, C2$w_2$, D1$w_3$, D2$w_4$" obtained by applying the window to the intermediate section of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 12B can be obtained by processing the inputs to which the window has been applied on the basis of the above-mentioned definitions of MDCT and IMDCT.

The decoder creates outputs to which the same window as applied in the encoder is applied after applying the IMDCT. The decoder can finally reconstruct the signal of the "C" section, that is, "C1C2", by overlap-adding the two outputs. At this time, the signal other than the "C" section is cancelled by applying the condition (Math Figure 2) necessary for perfect reconstruction as described above.

FIG. 12C is a diagram schematically illustrating an example where the MDCT/IMDCT is performed on the intermediate section and the rear section of the modified input. Referring to FIG. 12C, the encoder creates an input "C1$w_1$, C2$w_2$, D1$w_3$, D2$w_4$" obtained by applying the window to the intermediate section of the modified input and an input "D1$w_1$, D2$w_2$, D1$w_3$, D2$w_4$" obtained by applying the window to the rear section of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 12C can be obtained by processing the inputs to which the window has been applied on the basis of the above-mentioned definitions of MDCT and IMDCT.

The decoder creates outputs to which the same window as applied in the encoder is applied after applying the IMDCT. The decoder can finally reconstruct the signal of the "D" section, that is, "D1D2", by overlap-adding the two outputs. At this time, the signal other than the "D" section is cancelled by applying the condition (Math Figure 2) necessary for perfect reconstruction as described above.

Therefore, the decoder can finally perfectly reconstruct the current frame "CD" as shown in FIGS. 12B and 12C.

Embodiment 3

FIGS. 13A to 13E are diagrams schematically illustrating an example where a current frame is processed and reconstructed by MDCT/IMDCT by applying a window with a length of N/2 in the system according to the invention.

In the examples shown in FIGS. 13A to 13E, an analysis frame with a length of 5N/4 is used. For example, the analysis frame is constructed by adding a sub-section "B2" of a previous sub-frame "B" of a current frame to the front section "CD" of the current frame.

Figure 13A:
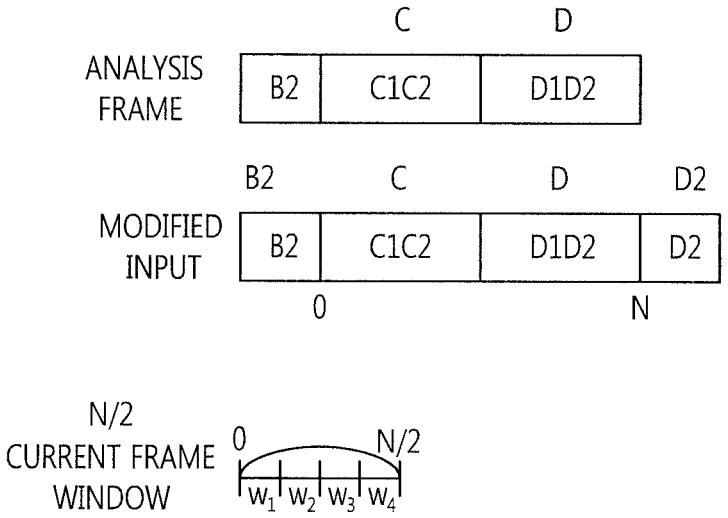
FIGS. 13A to 13E are diagrams schematically illustrating an example where a current frame is subjected to an MDCT/IMDCT and is reconstructed by applying a window of N/2 in a system according to the invention.

Referring to FIG. 13A, a modified input in this embodiment can be constructed by replicating a sub-section "D2" of a sub-frame "D" in the analysis frame and adding the replicated sub-section to the rear end thereof.

Here, the sub-frame section "C" includes sub-sections "C1" and "C2" as shown in the drawing, and a sub-frame section "D" also includes sub-sections "D1" and "D2" as shown in the drawing. Therefore, the modified input is "B2C1C2D1D2D2".

The current frame window with a length of N/2 used to perform the MDCT/IMDCT includes four sections each corresponding to a half length of the sub frame. The sub-sections of the modified input "B2C1C2D1D2D2" include smaller sections to correspond to the sections of the current frame window. For example, "B2" includes "B21 B22", "C" includes "C11C12", "C2" includes "C21C22", "D1" includes "D11D12", and "D2" includes "D21D22".

The encoder performs the MDCT/IMDCT the section "B2C1" and the section "C1C2" of the modified input by applying the current frame window with a length of N/2 thereto. The encoder performs the MDCT/IMDCT on the section "C1C2" and the section "C2D1" of the modified input by applying the current frame window with a length of N/2 thereto.

The encoder performs the MDCT/IMDCT on the section "C2D1" and the section "D1D2" of the modified input by applying the current frame window with a length of N/2 thereto, and performs the MDCT/IMDCT on the section "D1D2" and the section "D2D2" of the modified input by applying the current frame window with a length of N/2 thereto.

Figure 13B:
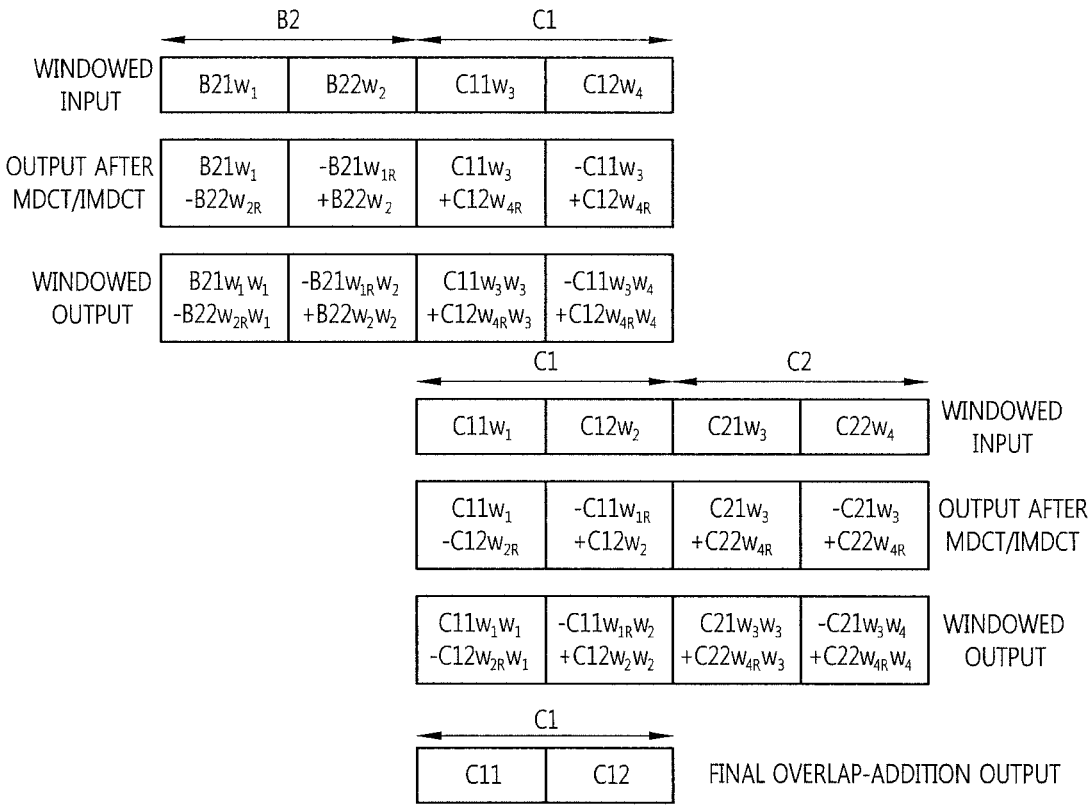

FIG. 13B is a diagram schematically illustrating an example where the MDCT/IMDCT is performed on the section "B2C1" and the section "C1C2" of the modified input. Referring to FIG. 13B, the encoder creates an input "B21$w_1$, B22$w_2$, C11$w_3$, C12$w_4$" obtained by applying the window to the section "B2C1" of the modified input and an input "C11$w_1$, C12$w_2$, C21$w_3$, C22$w_4$" obtained by applying the window to the section "C1C2" of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 13B can be obtained by processing the inputs to which the window has been applied on the basis of the above-mentioned definitions of MDCT and IMDCT.

The decoder creates outputs to which the same window as applied in the encoder is applied after applying the IMDCT. The decoder can finally reconstruct the signal of the section "C1", that is, "C11C12", by overlap-adding the two outputs. At this time, the signal other than the section "C1" is cancelled by applying the condition (Math Figure 2) necessary for perfect reconstruction as described above.

Figure 13C:
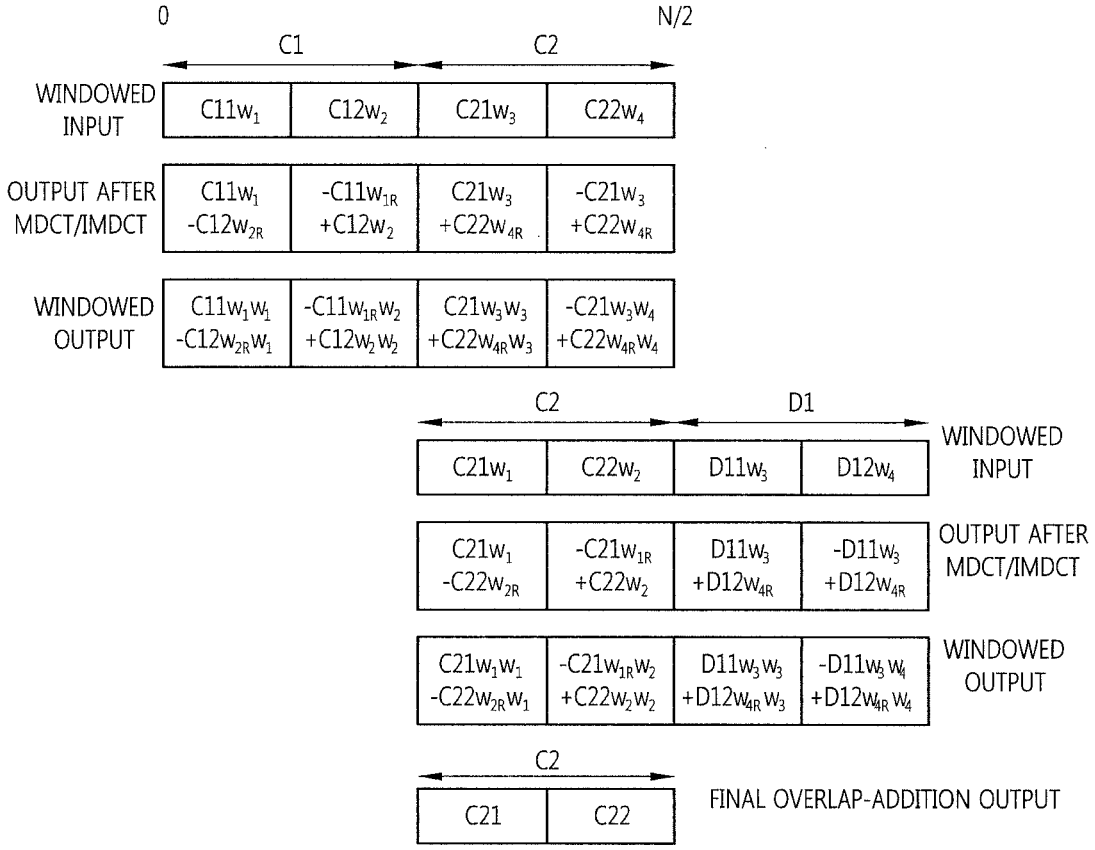

FIG. 13C is a diagram schematically illustrating an example where the MDCT/IMDCT is performed on the "C1C2" section and the "C2D1" section of the modified input. Referring to FIG. 13C, the encoder creates an input "C11$w_1$, C12$w_2$, C21$w_3$, C22$w_4$" obtained by applying the window to the section "C1C2" of the modified input and an input "C21$w_1$, C22$w_2$, D11$w_3$, D12$w_4$" obtained by applying the window to the section "C2D1" of the modified input. Then, the encoder and the decoder can perform the MDCT/IMDCT and windowing and overlap-adding the output as described with reference to FIG. 13B, whereby it is possible to reconstruct the signal of the section "C2", that is, "C21C22". At this time, the signal other than the section "C2" is cancelled by applying the condition (Math Figure 2) necessary for perfect reconstruction as described above.

Figure 13D:
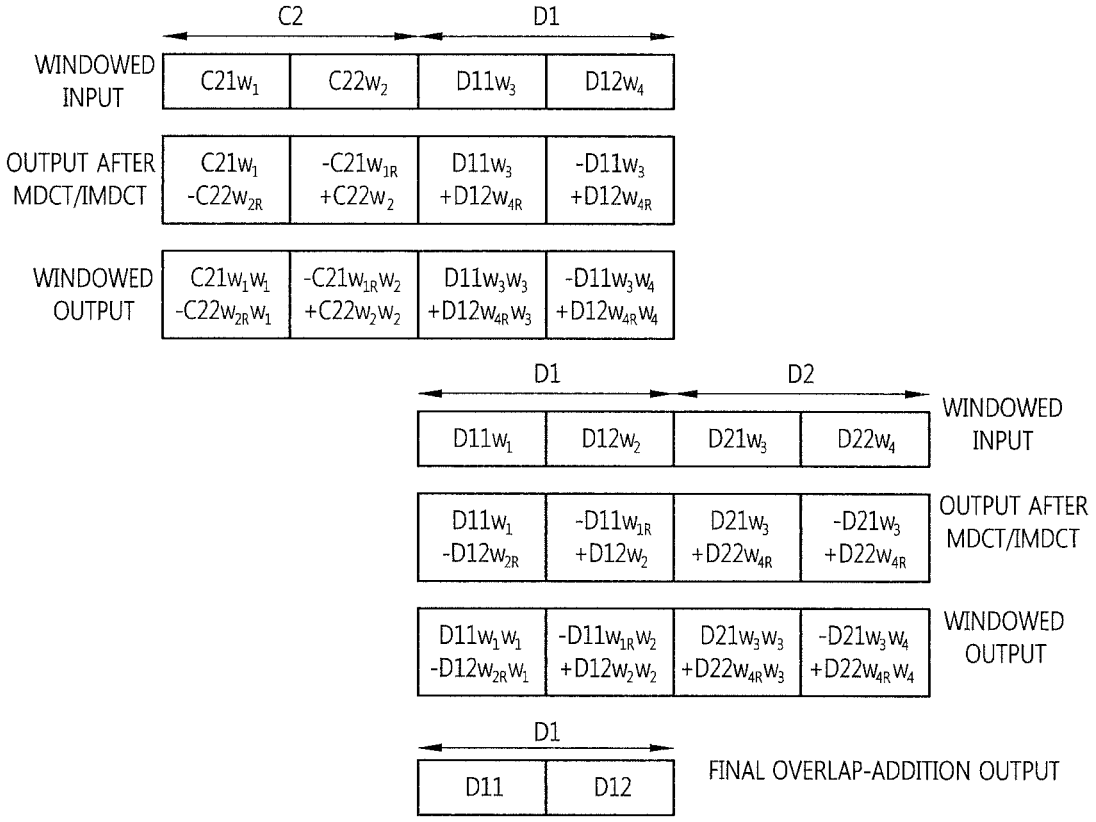

FIG. 13D is a diagram schematically illustrating an example where the MDCT/IMDCT is performed on the section "C2D1" and the section "D1D2" of the modified input. Referring to FIG. 13D, the encoder creates an input "C21$w_1$, C22$w_2$, D11$w_3$, D12$w_4$" obtained by applying the window to the section "C2D1" of the modified input and an input "D12$w_1$, D12$w_2$, D21$w_3$, D22$w_4$" obtained by applying the window to the section "D1D2" of the modified input. Then, the encoder and the decoder can perform the MDCT/IMDCT and windowing and overlap-adding the output as described with reference to FIGS. 13B and 13C, whereby it is possible to reconstruct the signal of the section "D1", that is, "D11D12". At this time, the signal other than the section "D1" is cancelled by applying the condition (Math Figure 2) necessary for perfect reconstruction as described above.

Figure 13E:
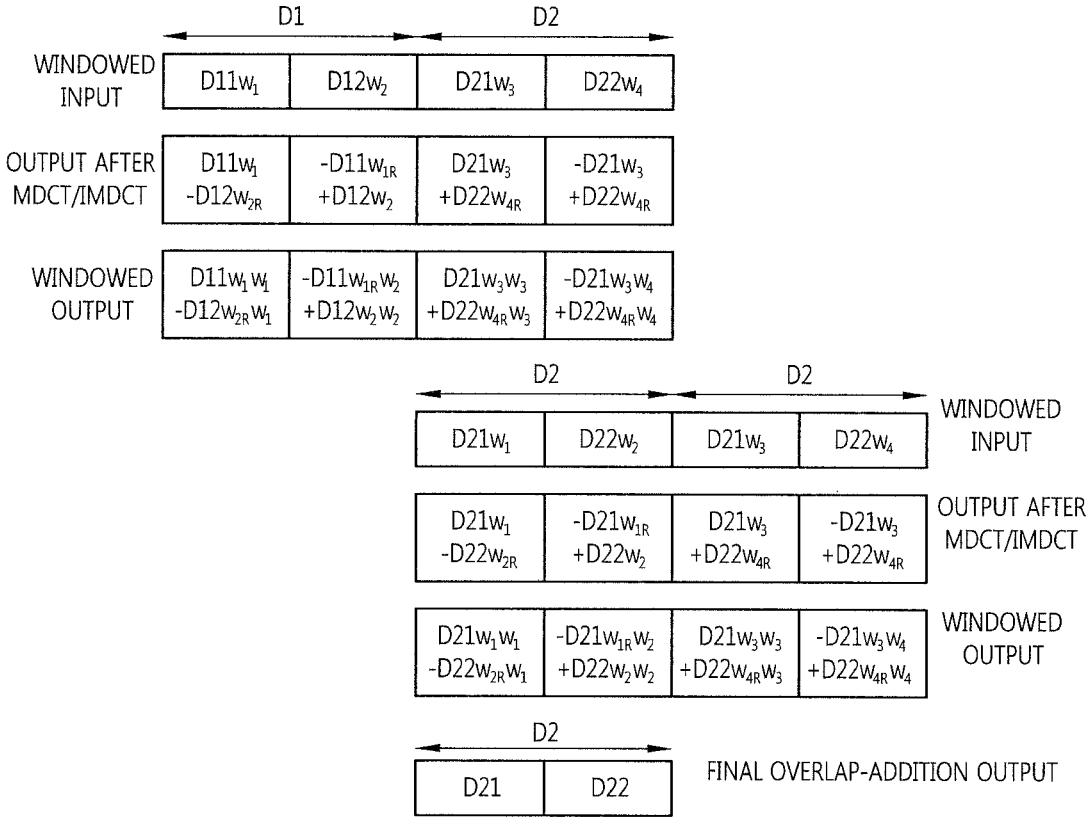

FIG. 13E is a diagram schematically illustrating an example where the MDCT/IMDCT is performed on the section "D1D2" and the section "D2D2" of the modified input. Referring to FIG. 13E, the encoder creates an input "D11$w_1$, D12$w_2$, D21$w_3$, D22$w_4$" obtained by applying the window to the section "D1D2" of the modified input and an input "D21$w_1$, D22$w_2$, D21$w_3$, D22$w_4$" obtained by applying the window to the section "D2D2" of the modified input. Then, the encoder and the decoder can perform the MDCT/IMDCT and windowing and overlap-add the output as described with reference to FIGS. 13B to 13D, whereby it is possible to reconstruct the signal of the section "D2", that is, "D21D22". At this time, the signal other than the section "D2" is cancelled by applying the condition (Math Figure 2) necessary for perfect reconstruction as described above.

As a result, the encoder/decoder can finally perfectly reconstruct the current frame "CD" as shown in FIGS. 13A to 13E by performing the MDCT/IMDCT by sections.

Embodiment 4

Figure 14A:
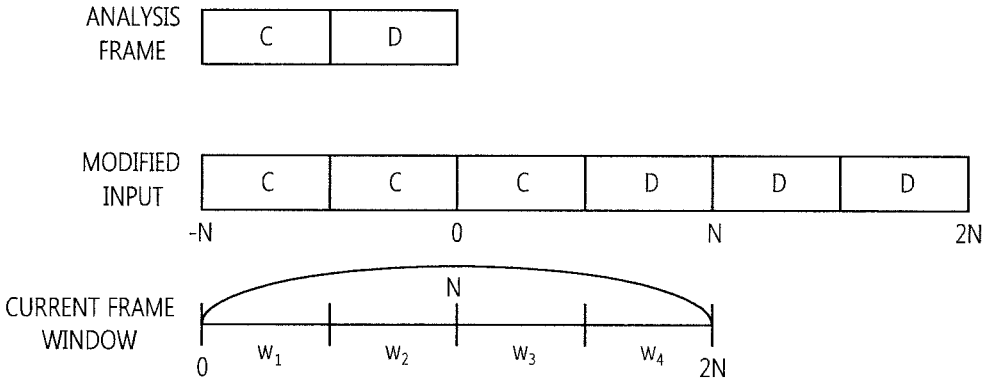

FIGS. 14A and 14B are diagrams schematically illustrating an example where a current frame is processed and reconstructed by MDCT/IMDCT by applying a window with a length of 2N in the system according to the invention.

In the examples shown in FIGS. 14A and 14B, an analysis frame with a length of N is used. For example, a current frame "CD" can be used as the analysis frame.

Referring to FIG. 14A, a modified input in this embodiment can be constructed as "CCCDDD" by replicating a sub-frame "C" in the analysis frame, adding the replicated sub-frame to the front end thereof, replicating a sub-frame "D", adding the replicated sub-frame to the rear end thereof.

The current frame window with a length of 2N used to perform the MDCT/IMDCT includes four sections each corresponding to the length of the sub frame.

The encoder performs the MDCT/IMDCT on the front section "CCCD" of the modified input and the rear section "CDDD" of the modified input by applying the current frame window to the front section and the rear section of the modified input.

FIG. 14B is a diagram schematically illustrating an example where the MDCT/IMDCT is performed on the "CCCD" section and the "CDDD" section of the modified input. Referring to FIG. 14B, the encoder creates an input "$Cw_1$, $Cw_2$, $Cw_3$, $Dw_4$" obtained by applying the window to the "CCCD" section of the modified input and an input "$Cw_1$, $Dw_2$, $Dw_3$, $Dw_4$" obtained by applying the window to the "CDDD" section of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 14B can be obtained by processing the inputs to which the window has been applied on the basis of the above-mentioned definitions of MDCT and IMDCT.

The decoder creates outputs to which the same window as applied in the encoder is applied after applying the IMDCT. The decoder can finally reconstruct the current frame "CD" by overlap-adding the created two outputs. At this time, the signal other than the "CD" section is cancelled by applying the condition (Math Figure 2) necessary for perfect reconstruction as described above.

Embodiment 5

Figure 15A:
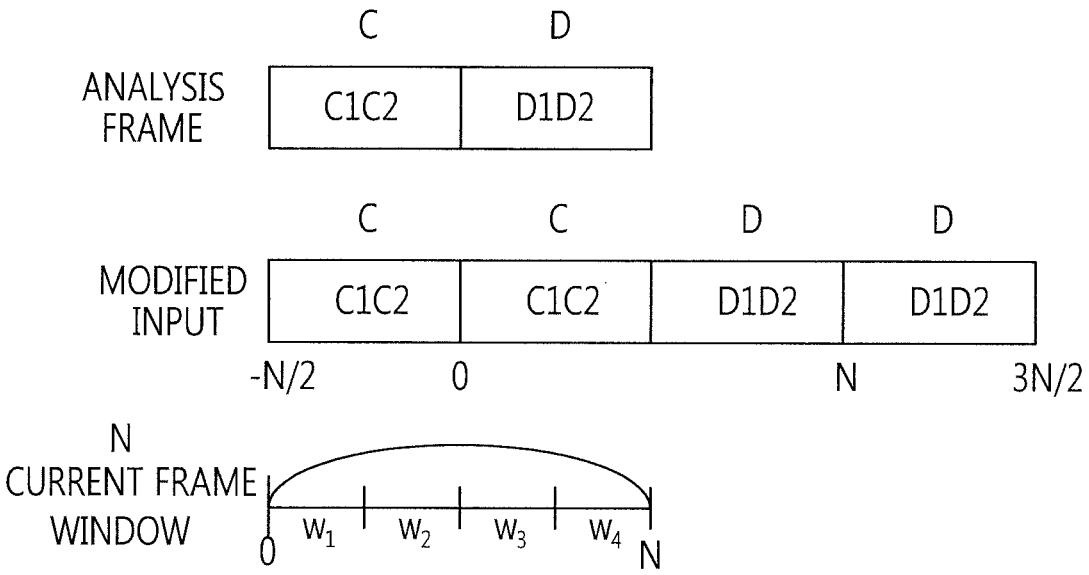
FIGS. 15A to 15C are diagrams schematically illustrating another example where a current frame is subjected to an MDCT/IMDCT and is reconstructed by applying a window of N in a system according to the invention.
Figure 15B:
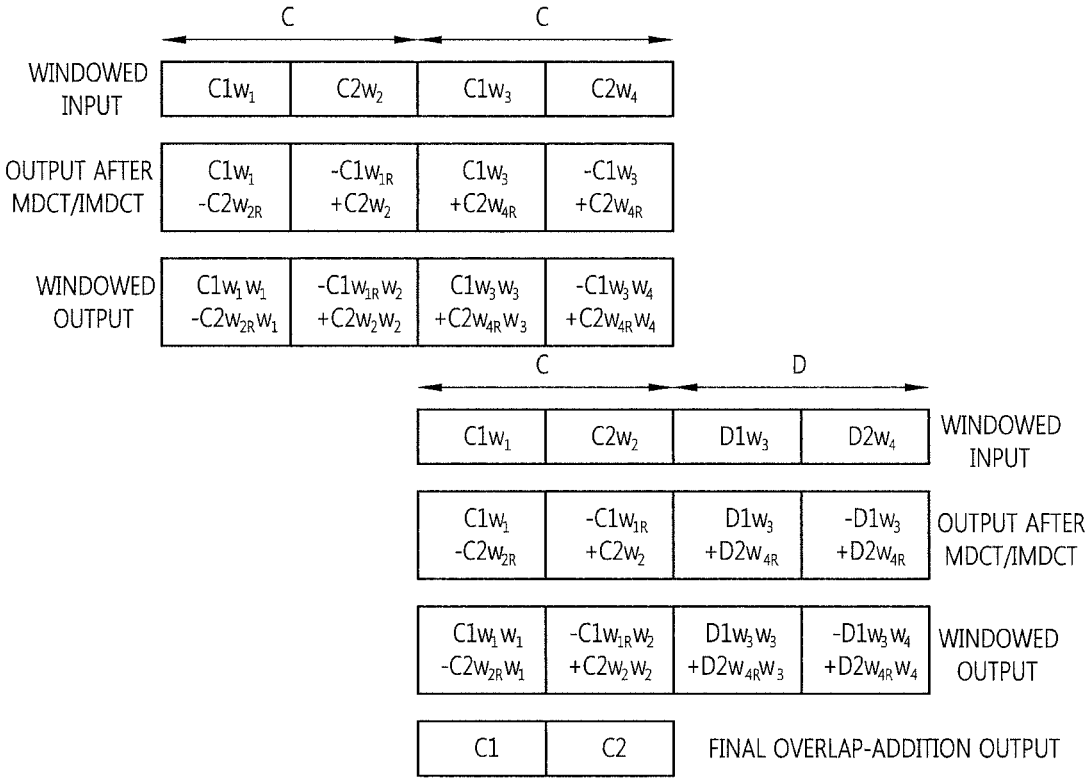
Figure 15C:
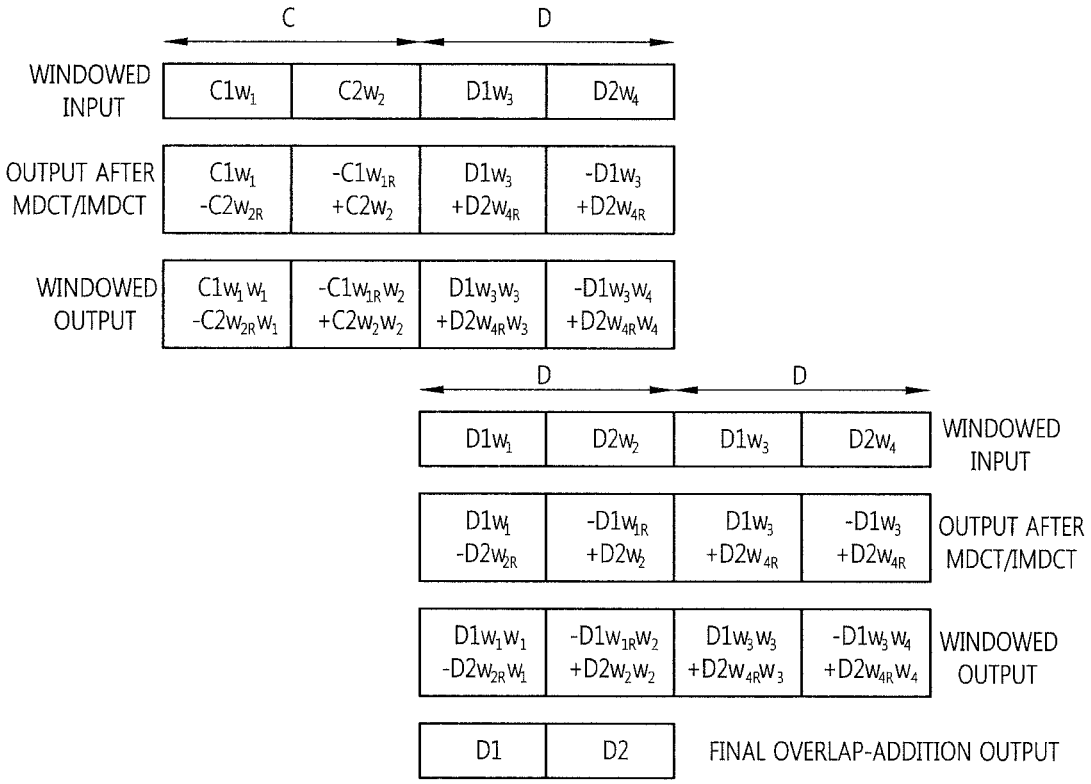

FIGS. 15A to 15C are diagrams schematically illustrating an example where a current frame is processed and reconstructed by MDCT/IMDCT by applying a window with a length of N in the system according to the invention.

In the examples shown in FIGS. 15A to 15C, an analysis frame with a length of N is used. Therefore, in this embodiment, the current frame "CD" can be used as the analysis frame.

Referring to FIG. 15A, the modified input in this embodiment can be constructed as "CCDD" by replicating the sub-frame "C" in the analysis frame, adding the replicated sub-frame to the front end thereof, replicating the sub-frame "D", and adding the replicated sub-frame to the rear end thereof. At this time, the sub-frame section "C" includes sub-sections "C1" and "C2" as shown in the drawing, and the sub-frame section "D" includes sub-sections "D1" and "D2" as shown in the drawing. Therefore, the modified input can be said to include "C1C2C1C2D1D2D1D2".

The current frame window with a length of N used to perform the MDCT/IMDCT includes four sections each corresponding to the length of the sub-frame.

The encoder applies the current frame window with a length of N to the section "CC" and the section "CD" of the modified input to perform the MDCT/IMDCT thereon and applies the current frame window with a length of N to the section "CD" and the section "DD" to perform the MDCT/IMDCT thereon.

FIG. 15B is a diagram schematically illustrating an example where the MDCT/IMDCT is performed on the section "CC" and the section "CD" of the modified input. Referring to FIG. 15B, the encoder creates an input "C1$w_1$, C2$w_2$, C1$w_3$, C2$w_4$" obtained by applying the window to the section "CC" of the modified input, creates an input "C1$w_1$, C2$w_2$, D1$w_3$, D2$w_4$" obtained by applying the window to the section "CD" of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 15B can be obtained by processing the inputs to which the window has been applied on the basis of the above-mentioned definitions of MDCT and IMDCT.

The decoder creates outputs to which the same window as applied in the encoder is applied after applying the IMDCT. The decoder can finally reconstruct the signal of the "C" section, that is, "C1C2", by overlap-adding the two outputs. At this time, the signal other than the "C" section is cancelled by applying the condition (Math Figure 2) necessary for perfect reconstruction as described above.

FIG. 15C is a diagram schematically illustrating an example where the MDCT/IMDCT is performed on the section "CD" and the section "DD" of the modified input. Referring to FIG. 15C, the encoder creates an input "C1$w_1$, C2$w_2$, D1$w_3$, D2$w_4$" obtained by applying the window to the section "CD" of the modified input and an input "D1$w_1$, D2$w_2$, D1$w_3$, D2$w_4$" obtained by applying the window to the section "DD" of the modified input. Then, the encoder and the decoder can perform the MDCT/IMDCT and windowing and overlap-add the output as described with reference to FIG. 15B, whereby it is possible to reconstruct the signal of the section "D", that is, "D1D2". At this time, the signal other than the "D" section is cancelled by applying the condition (Math Figure 2) necessary for perfect reconstruction as described above.

As a result, the encoder/decoder can finally perfectly reconstruct the current frame "CD" as shown in FIGS. 15A to 15C by performing the MDCT/IMDCT by sections.

Embodiment 6

FIGS. 16A to 16E are diagrams schematically illustrating an example where a current frame is processed and reconstructed by MDCT/IMDCT by applying a window with a length of N/2 in the system according to the invention.

In the examples shown in FIGS. 16A to 16E, an analysis frame with a length of N is used. Therefore, a current frame can be used as the analysis frame.

Figure 16A:
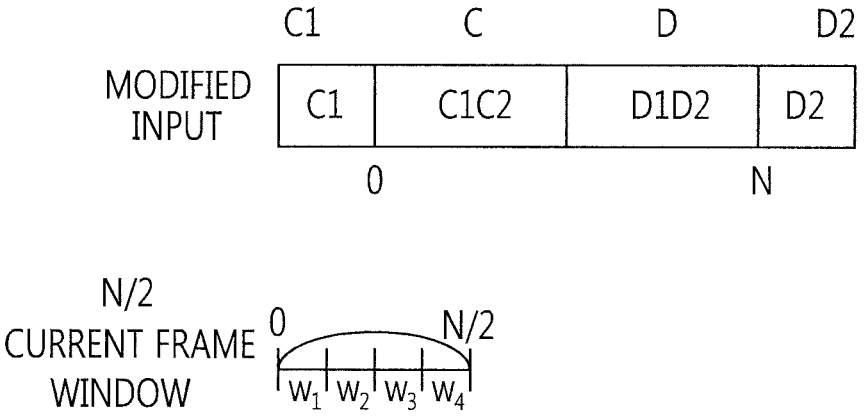
FIGS. 16A to 16E are diagrams schematically illustrating another example where a current frame is subjected to an MDCT/IMDCT and is reconstructed by applying a window of N/2 in a system according to the invention.

Referring to FIG. 16A, a modified input in this embodiment can be constructed as "C1C1C2D1D2D2" by replicating a sub-section "C1" of a sub-frame "C" in the analysis frame, adding the replicated sub-section to the front end thereof, replicating a sub-section "D2" of a sub-frame "D" in the analysis frame, adding the replicated sub-section to the rear end thereof.

The current frame window with a length of N/2 used to perform the MDCT/IMDCT includes four sections each corresponding to a half length of the sub frame. The sub-sections of the modified input "C1C1C2D1D2D2" include smaller sections to correspond to the sections of the current frame window. For example, "C1" includes "C11C12", "C2" includes "C21C22", "D1" includes "D11D12", "and D2" includes "D21D22".

The encoder performs the MDCT/IMDCT the section "C1C1" and the section "C1C2" of the modified input by applying the current frame window with a length of N/2 thereto. The encoder performs the MDCT/IMDCT on the section "C1C2" and the section "C2D1" of the modified input by applying the current frame window with a length of N/2 thereto.

The encoder performs the MDCT/IMDCT on the section "C2D1" and the section "D1D2" of the modified input by applying the current frame window with a length of N/2 thereto, and performs the MDCT/IMDCT on the section "D1D2" and the section "D2D2" of the modified input by applying the current frame window with a length of N/2 thereto.

Figure 16B:
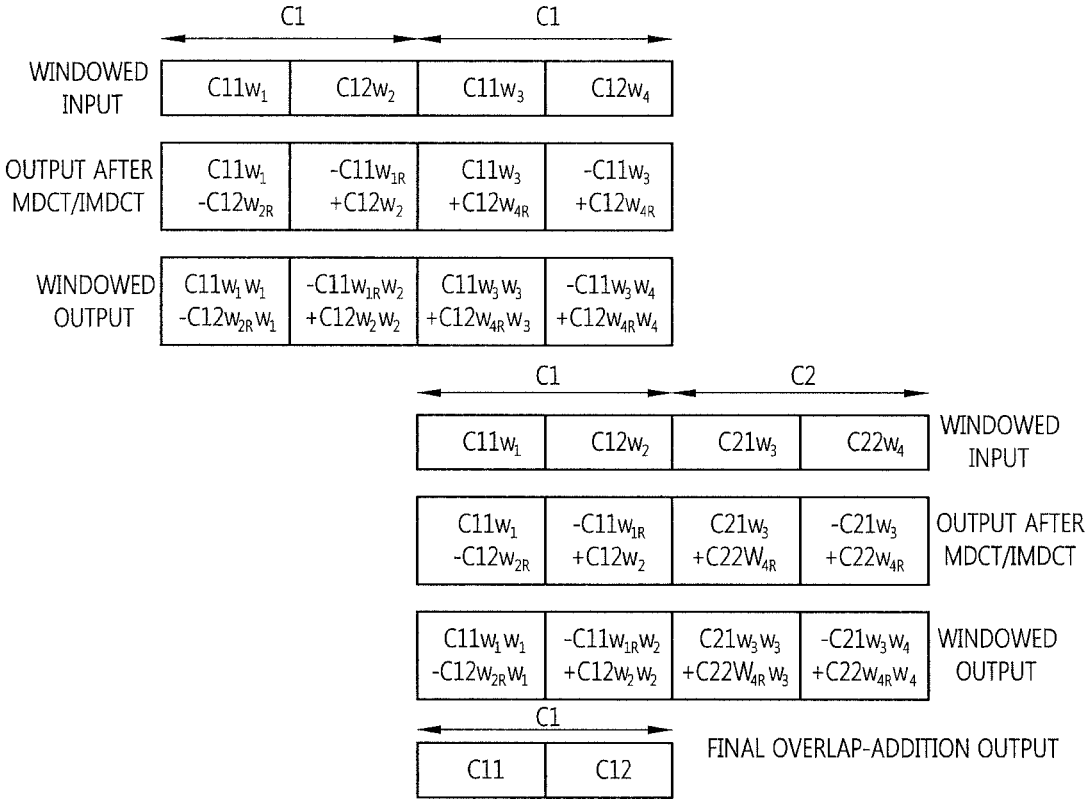

FIG. 16B is a diagram schematically illustrating an example where the MDCT/IMDCT is performed on the section "C1C1" and the section "C1C2" of the modified input. Referring to FIG. 16B, the encoder creates an input "C11$w_1$, C12$w_2$, C11$w_3$, C12$w_4$" obtained by applying the window to the section "C1C1" of the modified input and an input "C11$w_1$, C12$w_2$, C21$w_3$, C22$w_4$" obtained by applying the window to the section "C1C2" of the modified input, and applies the MDCT on the created two inputs.

The encoder transmits the encoded information to the decoder after applying the MDCT to the inputs, and the decoder obtains the inputs to which the MDCT has been applied from the received information and applies the IMDCT on the obtained inputs.

The MDCT/IMDCT results shown in FIG. 16B can be obtained by processing the inputs to which the window has been applied on the basis of the above-mentioned definitions of MDCT and IMDCT.

The decoder generates outputs to which the same window as applied in the encoder is applied after applying the IMDCT. The decoder can finally reconstruct the signal of the section "C1", that is, "C11C12", by overlap-adding the two outputs. At this time, the signal other than the "C1" section is cancelled by applying the condition (Math Figure 2) necessary for perfect reconstruction as described above.

Figure 16C:
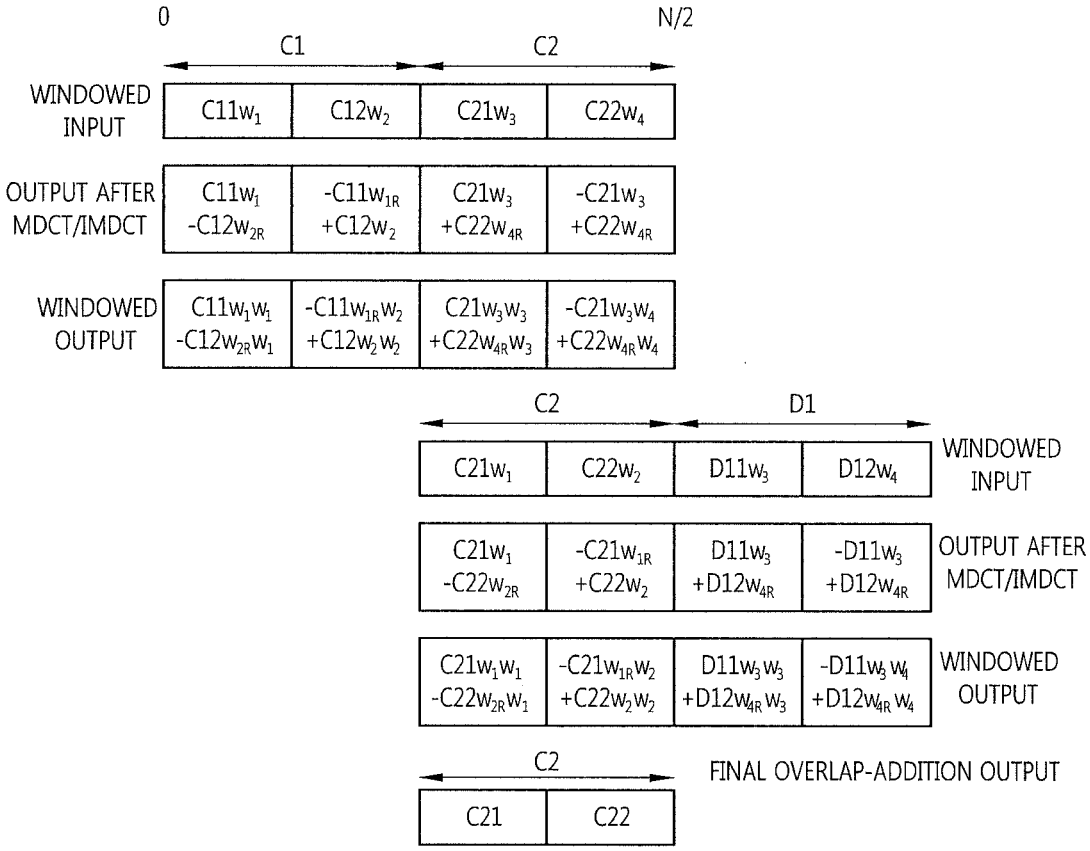

FIG. 16C is a diagram schematically illustrating an example where the MDCT/IMDCT is performed on the "C1C2" section and the "C2D1" section of the modified input. Referring to FIG. 16C, the encoder generates an input "C11$w_1$, C12$w_2$, C21$w_3$, C22$w_4$" obtained by applying the window to the section "C1C2" of the modified input and an input "C21$w_1$, C22$w_2$, D11$w_3$, D12$w_4$" obtained by applying the window to the section "C2D1" of the modified input. Then, the encoder and the decoder can perform the MDCT/IMDCT and windowing and overlap-adding the output as described with reference to FIG. 16B, whereby it is possible to reconstruct the signal of the section "C2", that is, "C21C22". At this time, the signal other than the "C2" section is cancelled by applying the condition (Math Figure 2) necessary for perfect reconstruction as described above.

Figure 16D:
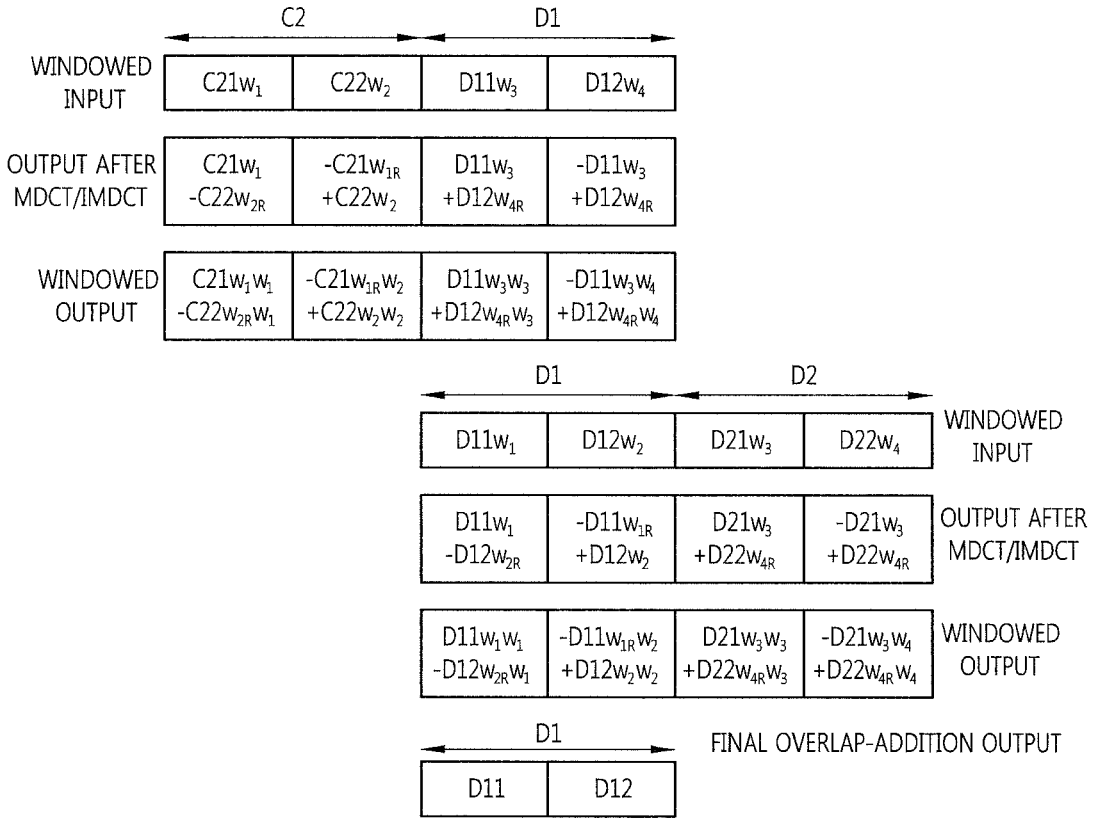

FIG. 16D is a diagram schematically illustrating an example where the MDCT/IMDCT is performed on the "C2D1" section and the "D1D2" section of the modified input. Referring to FIG. 16D, the encoder generates an input "C21$w_1$, C22$w_2$, D11$w_3$, D12$w_4$" obtained by applying the window to the section "C2D1" of the modified input and an input "D12$w_1$, D12$w_2$, D21$w_3$, D22$w_4$" obtained by applying the window to the section "D1D2" of the modified input. Then, the encoder and the decoder can perform the MDCT/IMDCT and windowing and overlap-adding the output as described with reference to FIGS. 16B and 16C, whereby it is possible to reconstruct the signal of the "D1" section, that is, "D11D12". At this time, the signal other than the "D1" section is cancelled by applying the condition (Math Figure 2) necessary for perfect reconstruction as described above.

Figure 16E:
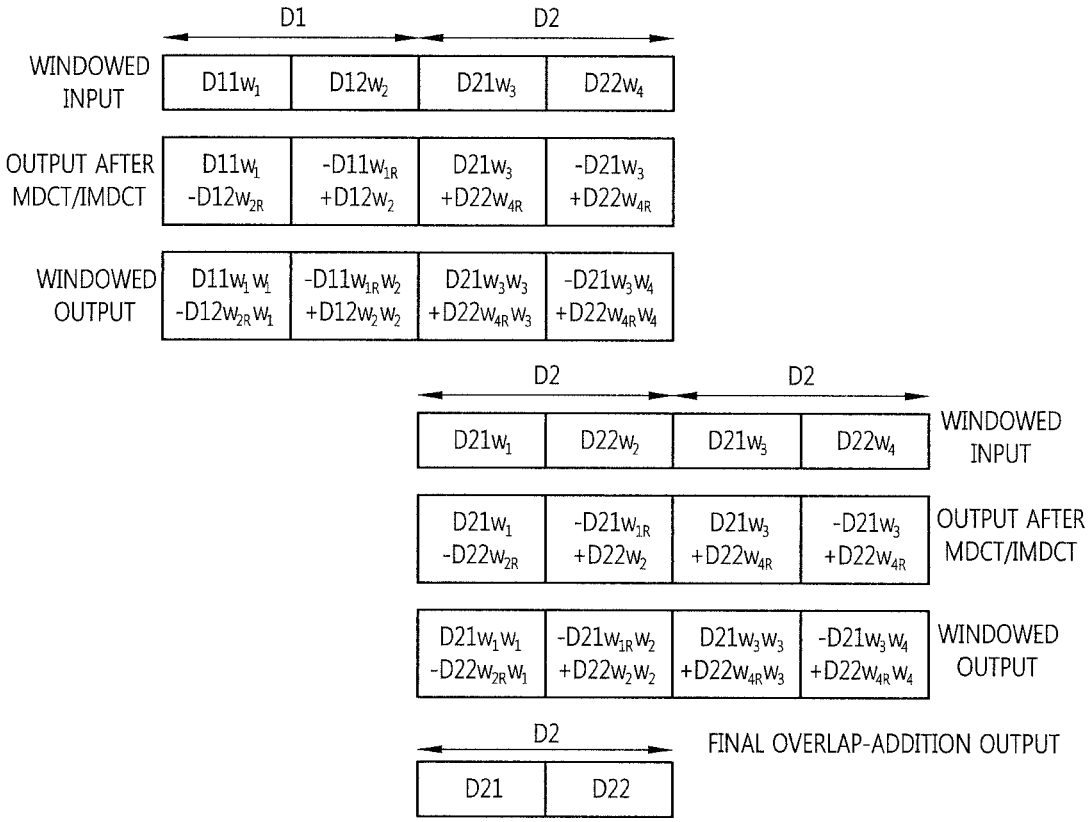

FIG. 16E is a diagram schematically illustrating an example where the MDCT/IMDCT is performed on the section "D1D2" and the section "D2D2" of the modified input. Referring to FIG. 16E, the encoder generates an input "D11$w_1$, D12$w_2$, D21$w_3$, D22$w_4$" obtained by applying the window to the section "D1D2" of the modified input and an input "D21$w_1$, D22$w_2$, D21$w_3$, D22$w_4$" obtained by applying the window to the section "D2D2" of the modified input. Then, the encoder and the decoder can perform the MDCT/IMDCT and windowing and overlap-add the output as described with reference to FIGS. 16B to 16D, whereby it is possible to reconstruct the signal of the section "D2", that is, "D21D22". At this time, the signal other than the section "D2" is cancelled by applying the condition (Math Figure 2) necessary for perfect reconstruction as described above.

As a result, the encoder/decoder can finally perfectly reconstruct the current frame "CD" as shown in FIGS. 16A to 16E by performing the MDCT/IMDCT by sections.

Embodiment 7

FIGS. 17A to 17D are diagrams schematically illustrating another example where a current frame is processed and reconstructed by MDCT/IMDCT by applying a window with a length of 2N in the system according to the invention.

The process of performing the MDCT/IMDCT will be described below with reference to FIGS. 2 and 3. The MDCT unit 200 of the encoder can receive the side information on the lengths of the analysis frame/modified input, the window type/length, the assigned bits, and the like via the secondary path 260. The side information is transmitted to the buffer 210, the modification unit 220, the windowing unit 230, the forward transform unit 240, and the formatter 250.

Figure 17A:
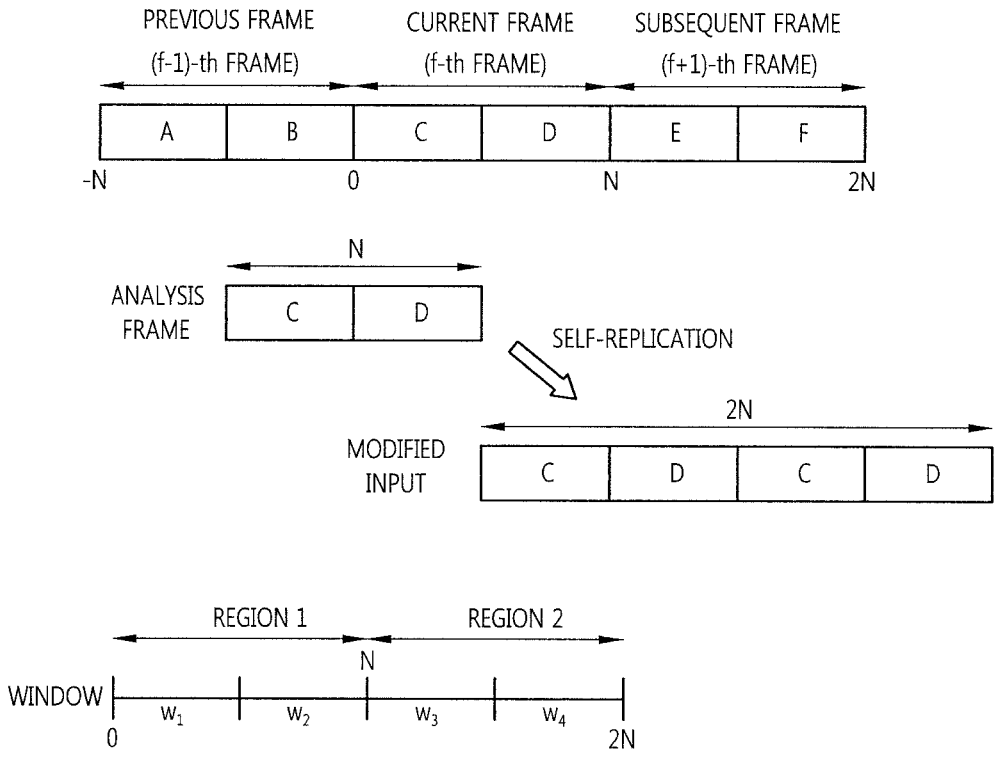
FIGS. 17A to 17D are diagrams schematically illustrating another example where a current frame is subjected to an MDCT/IMDCT and is reconstructed by applying a window of 2N in a system according to the invention.

When time-domain samples are input as an input signal, the buffer 210 generates a block or frame sequence of the input signal. For example, as shown in FIG. 17A, a sequence of the current frame "CD", the previous frame "AB", and the subsequent frame "EF" can be generated.

As shown in the drawing, the length of the current frame "CD" is N and the lengths of the sub-frames "C" and "D" of the current frame "CD" are N/2.

In this embodiment, an analysis frame with a length of N is used as shown in the drawing, and thus the current frame can be used as the analysis frame.

The modification unit 220 can generate a modified input with a length of 2N by self-replicating the analysis frame. In this embodiment, the modified input "CDCD" can be generated by self-replicating the analysis frame "CD" and adding the replicated frame to the front end or the rear end of the analysis frame.

The windowing unit 230 applies the current frame window with a length of 2N to the modified input with a length of 2N. The length of the current frame window is 2N as shown in the drawing and includes four sections each corresponding to the length of each section (sub-frame "C" and "D") of the modified input. Each section of the current frame window satisfies the relationship of Math Figure 2.

Figure 17B:
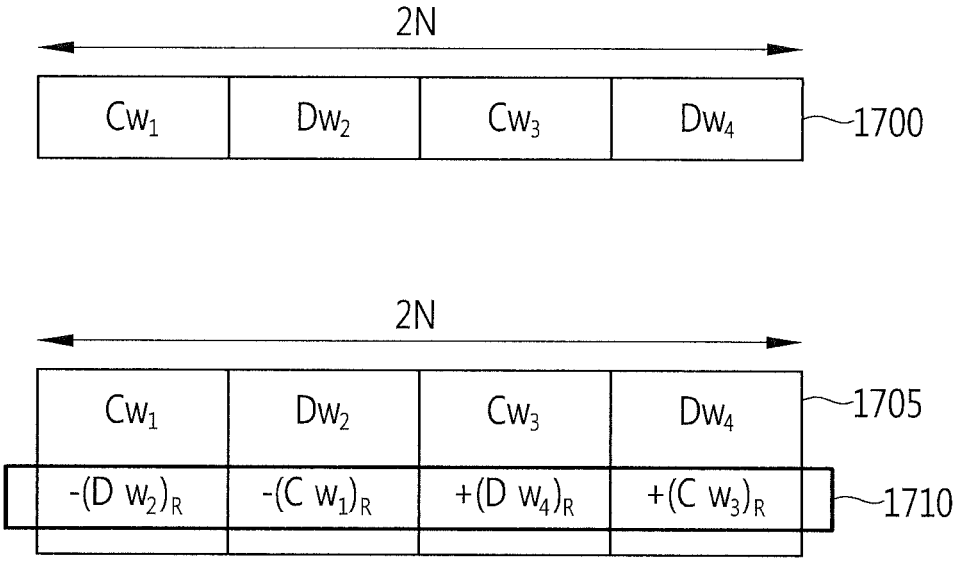

FIG. 17B is a diagram schematically illustrating an example where the MDCT is applied to the modified input having the window applied thereto.

The windowing unit 230 outputs a modified input 1700 "Cw1, Dw2, Cw3, Dw4" to which the window has been applied as shown in the drawing.

The forward transform unit 240 transforms the time-domain signal into a frequency-domain signal as described with reference to FIG. 2. The forward transform unit 240 uses the MDCT as the transform method. The forward transform unit 240 outputs a result 1705 in which the MDCT is applied to the modified input 1700 having the window applied thereto. In the signal subjected to the MDCT, "$-(Dw_2)_R$, $-(Cw_1)_R$, $(Dw_4)_R$, $(Cw_3)_R$" corresponds to an aliasing component 1710 as shown in the drawing.

The formatter 250 generates digital information including spectral information. The formatter 250 performs a signal compressing operation and an encoding operation and performs a bit packing operation. In general, for the purpose of storage and transmission, the spectral information is binarized along with the side information in the course of compressing the time-domain signal using an encoding block to generate a digital signal. The formater can perform processes based on a quantization scheme and a psychoacoustic model, can perform a bit packing operation, and can generate side information.

The de-formatter 310 of the IMDCT unit 300 of the decoder performs the functions associated with decoding a signal. Parameters and the side information (block/frame size, window length/shape, and the like) encoded with the binarized bits are decoded.

The side information of the extracted information can be transmitted to the inverse transform unit 320, the windowing unit 330, the modified overlap-adding processor 340, and the output processor 350 via the secondary path 360.

The inverse transform unit 320 generates frequency-domain coefficients from the spectral information extracted by the de-formatter 310 and inversely transforms the coefficients into the time-domain signal. The inverse transform used at this time corresponds to the transform method used in the encoder. In the invention, the encoder uses the MDCT and the decoder uses the IMDCT to correspond thereto.

Figure 17C:
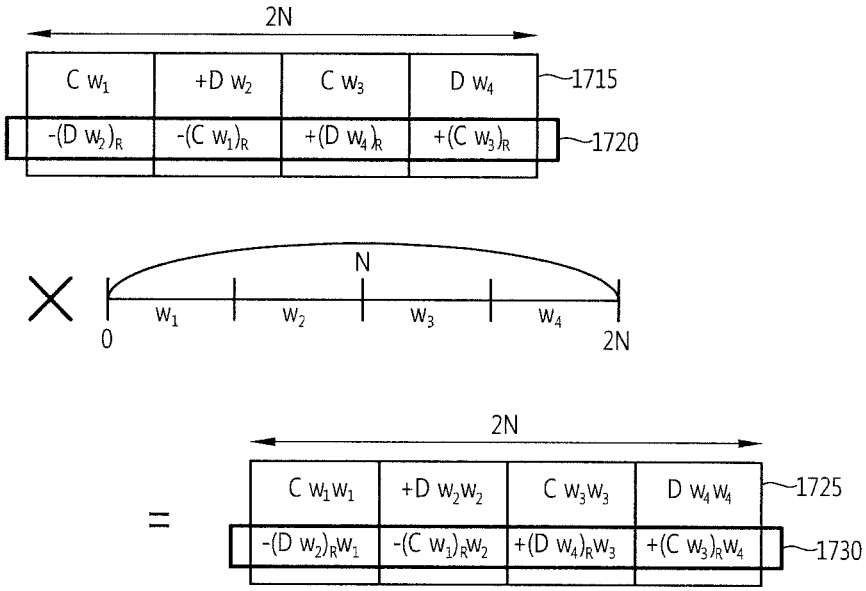

FIG. 17C is a diagram schematically illustrating the process of applying the IMDCT and then applying the window. As shown in the drawing, the inverse transform unit 320 generates a time-domain signal 1715 through the inverse transform. An aliasing component 1720 is continuously maintained and generated in the course of performing the MDCT/IMDCT.

The windowing unit 330 applies the same window as applied in the encoder to the time-domain coefficients generated through the inverse transform, that is, the IMDCT. In this embodiment, a window with a length of 2N including four sections w1, w2, w3, and w4 can be applied as shown in the drawing.

As shown in the drawing, it can be seen that an aliasing component 1730 is maintained in a result 1725 of application of the window.

The modified overlap-adding processor (or the modification unit) 350 reconstructs a signal by overlap-adding the time-domain coefficients having the window applied thereto.

Figure 17D:
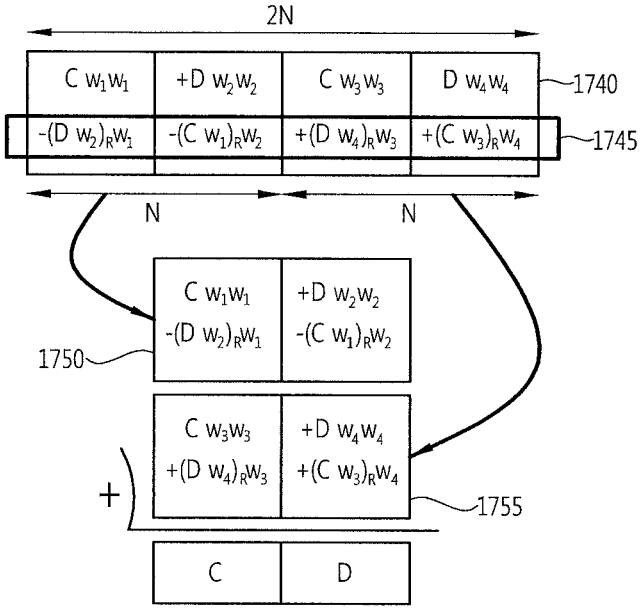

FIG. 17D is a diagram schematically illustrating an example of the overlap-adding method performed in the invention. Referring to FIG. 17D, in the result with a length of 2N obtained by applying the window to the modified input, performing the MDCT/IMDCT, and applying the window to the result again, the front section 1750 with a length of N and the rear section 1755 with a length of N can be overlap-added to perfectly reconstruct the current frame "CD".

The output processor 350 outputs the reconstructed signal.

Embodiment 8

FIGS. 18A to 18H are diagrams schematically illustrating an example where a current frame is processed and reconstructed by MDCT/IMDCT by applying a trapezoidal window in the system according to the invention.

The process of performing the MDCT/IMDCT will be described below with reference to FIGS. 2 and 3. The MDCT unit 200 of the encoder can receive the side information on the lengths of the analysis frame/modified input, the window type/length, the assigned bits, and the like via the secondary path 260. The side information is transmitted to the buffer 210, the modification unit 220, the windowing unit 230, the forward transform unit 240, and the formatter 250.

Figure 18A:
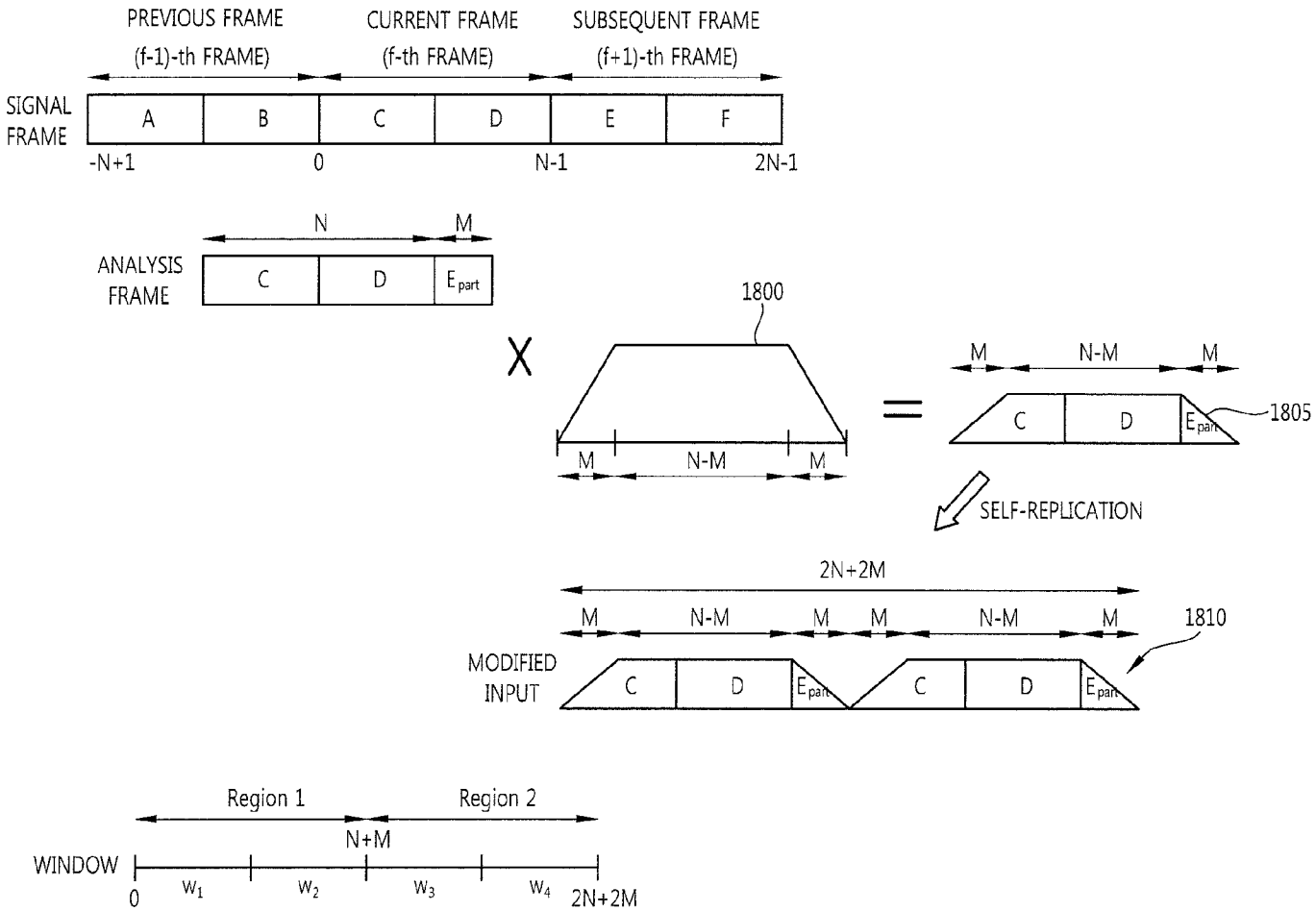
FIGS. 18A to 18H are diagrams schematically illustrating another example where a current frame is subjected to an MDCT/IMDCT and is reconstructed by applying a trapezoidal window in a system according to the invention.

When time-domain samples are input as an input signal, the buffer 210 generates a block or frame sequence of the input signal. For example, as shown in FIG. 18A, a sequence of the current frame "CD", the previous frame "AB", and the subsequent frame "EF" can be generated. As shown in the drawing, the length of the current frame "CD" is N and the lengths of the sub-frames "C" and "D" of the current frame "CD" are N/2.

In this embodiment, a look-ahead frame "$E_{part}$" with a length of M is added to the rear end of the current frame with a length of N and the result is used as the analysis frame for the purpose of the forward transform, as shown in the drawing. The look-ahead frame "$E_{part}$" is a part of the sub-frame "E" in the look-ahead frame "EF".

The modification unit 220 can generate a modified input by self-replicating the analysis frame. In this embodiment, the modified input "CD $E_{part}CDE_{part}$" can be generated by self-replicating the analysis frame "$CDE_{part}$" and adding the replicated frame to the front end or the rear end of the analysis frame. At this time, a trapezoidal window with a length of N+M may be first applied to the analysis frame with a length of N+M and then the self-replication may be performed.

Specifically, as shown in FIG. 18A, an analysis frame 1805 having a trapezoidal window 1800 with a length of N+M applied thereto can be self-replicated to generate a modified input 1810 with a length of 2N+2M.

The windowing unit 230 applies the current frame window with a length of 2N+2M to the modified input with a length of 2N. The length of the current frame window is 2N+2M as shown in the drawing and includes four sections each satisfying the relationship of Math Figure 2.

Here, instead of applying the current frame window with a length of 2N+2M again to the modified input generated by applying the trapezoidal window with a length of N+M, the current frame window having a trapezoidal shape can be once applied. For example, the modified input with a length of 2N+2M can be generated by applying the trapezoidal window with a length of N+M and then performing the self-replication. The modified input may be generated by self-replicating the frame section "$CDE_{part}$" itself not having the window applied thereto and then applying a window with a length 2N+2M having trapezoidal shapes connected.

Figure 18B:
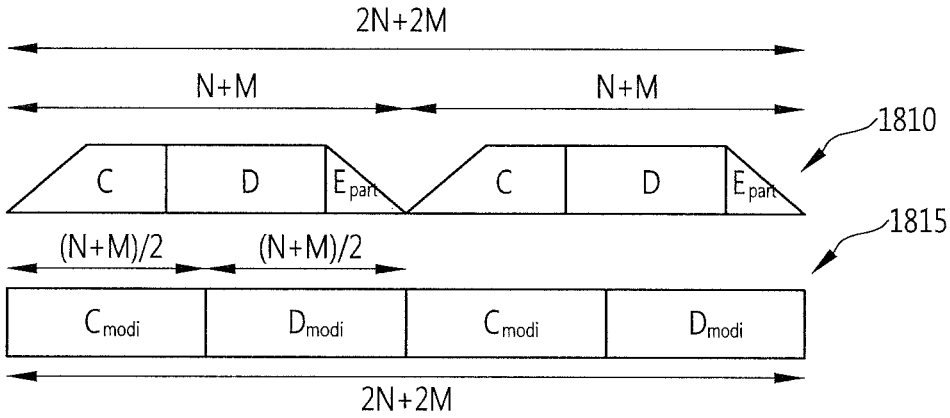

FIG. 18B is a diagram schematically illustrating an example where the current frame window is applied to the modified input. As shown in the drawing, the current frame window 1815 with the same length is applied to the modified input 1810 with a length of 2N+2M. For the purpose of convenience for explanation, sections of the modified window corresponding to the sections of the current frame window are defined as "$C_{modi}$" and "$D_{modi}$".

Figure 18C:
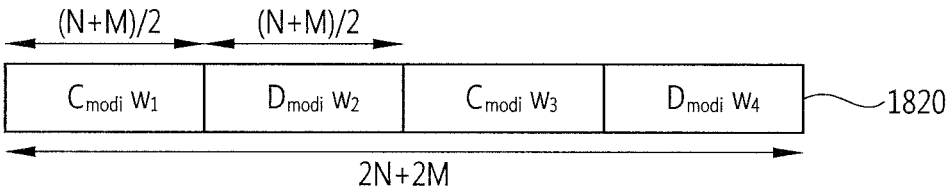
Figure 18D:
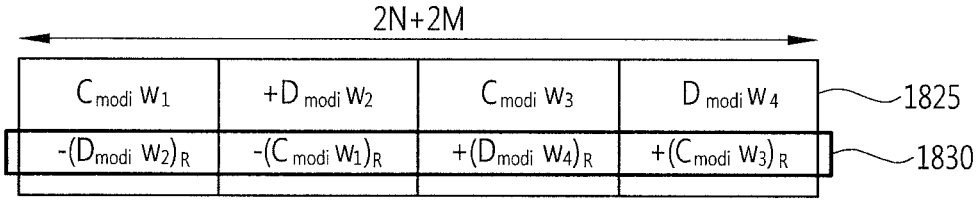

FIG. 18C is a diagram schematically illustrating the result of application of the current frame window to the modified input. As shown in 2*the* drawing, the windowing unit 230 can generates the result 1820 of application of the window, that is, "$C_{modi}$w1, $D_{modi}$w2, $C_{modi}$w3, $D_{modi}$w4".

The forward transform unit 240 transforms the time-domain signal into a frequency-domain signal as described with reference to FIG. 2. The forward transform unit 240 in the invention uses the MDCT as the transform method. The forward transform unit 240 outputs a result 1825 in which the MDCT is applied to the modified input 1820 having the window applied thereto. In the signal subjected to the MDCT, "$-(D_{modi}w_2)_R$, $-(C_{modi}w_1)_R$, $(D_{modi}w_4)_R$, $(C_{modi}w_3)_R$" corresponds to an aliasing component 1710 as shown in the drawing.

The formatter 250 generates digital information including spectral information. The formatter 250 performs a signal compressing operation and an encoding operation and performs a bit packing operation. In general, for the purpose of storage and transmission, the spectral information is binarized along with the side information in the course of compressing the time-domain signal using an encoding block to generate a digital signal. The formater can perform processes based on a quantization scheme and a psychoacoustic model, can perform a bit packing operation, and can generate side information.

The de-formatter 310 of the IMDCT unit 300 of the decoder performs the functions associated with decoding a signal. Parameters and the side information (block/frame size, window length/shape, and the like) encoded with the binarized bits are decoded.

The side information of the extracted information can be transmitted to the inverse transform unit 320, the windowing unit 330, the modified overlap-adding processor 340, and the output processor 350 via the secondary path 360.

The inverse transform unit 320 generates frequency-domain coefficients from the spectral information extracted by the de-formatter 310 and inversely transforms the coefficients into the time-domain signal. The inverse transform used at this time corresponds to the transform method used in the encoder. In the invention, the encoder uses the MDCT and the decoder uses the IMDCT to correspond thereto.

Figure 18E:
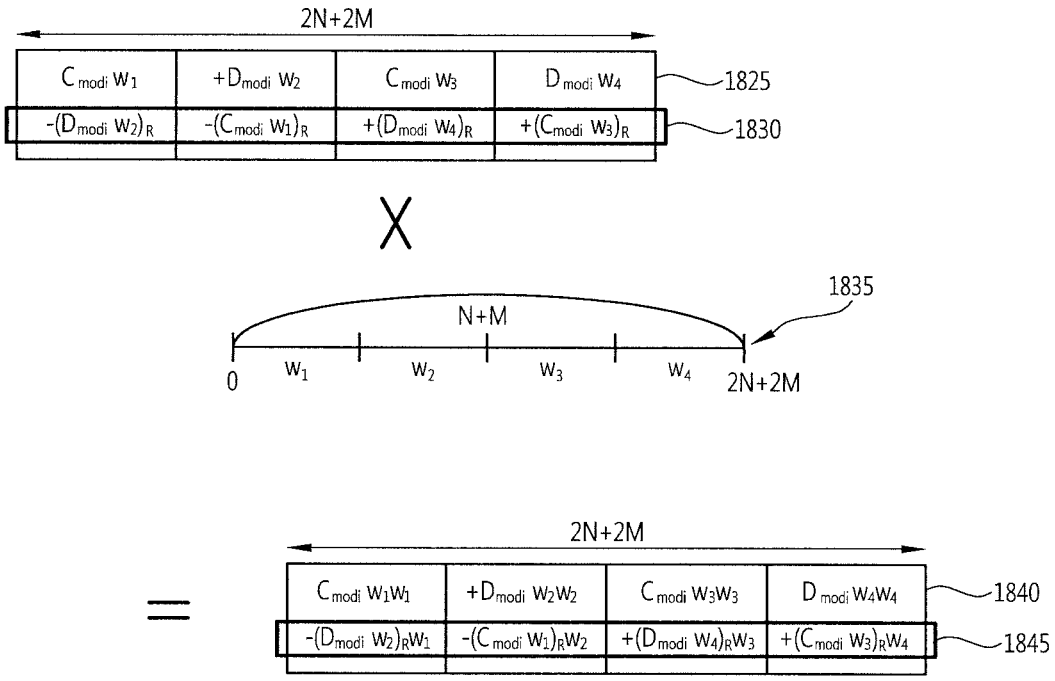

FIG. 18E is a diagram schematically illustrating the process of applying the IMDCT and then applying the window.

As shown in the drawing, the inverse transform unit 320 generates a time-domain signal 1825 through the inverse transform. In this embodiment, the length of the section on which the transform is performed is 2N+2M, as described above. An aliasing component 1830 is continuously maintained and generated in the course of performing the MDCT/IMDCT.

The windowing unit 330 applies the same window as applied in the encoder to the time-domain coefficients generated through the inverse transform, that is, the IMDCT. In this embodiment, a window with a length of 2N+2M including four sections w1, w2, w3, and w4 can be applied as shown in the drawing.

As shown in FIG. 18E, it can be seen that an aliasing component 1730 is maintained in a result 1725 of application of the window.

The modified overlap-adding processor (or the modification unit) 350 reconstructs a signal by overlap-adding the time-domain coefficients having the window applied thereto.

Figure 18F:
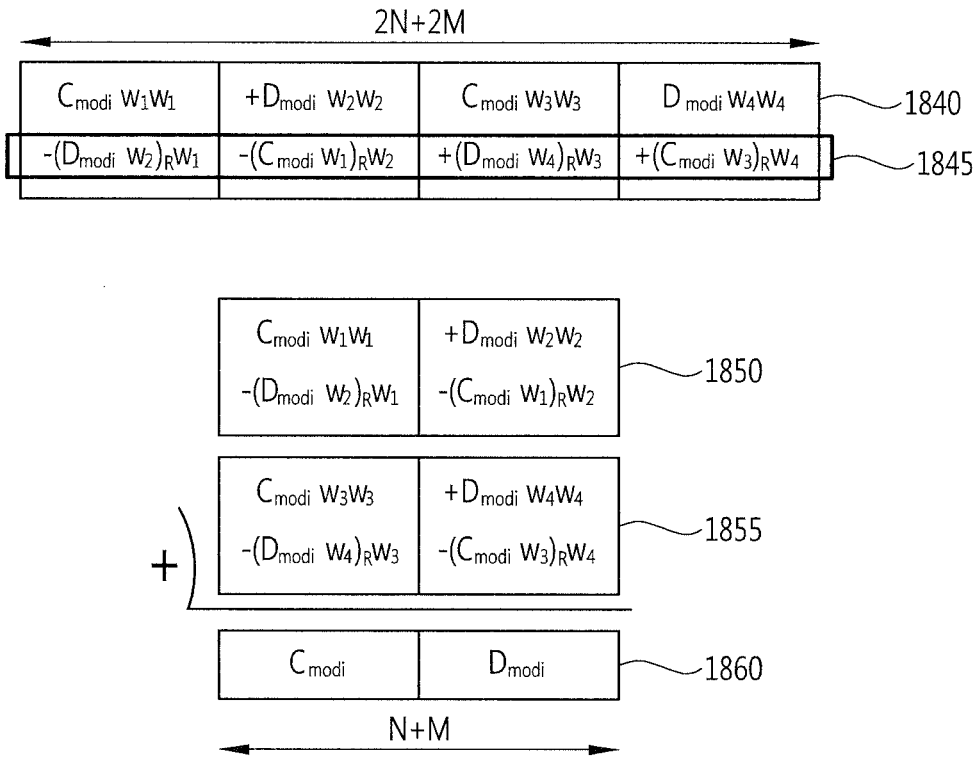

FIG. 18F is a diagram schematically illustrating an example of the overlap-adding method performed in the invention. Referring to FIG. 18F, in the result 1840 with a length of 2N obtained by applying the window to the modified input, performing the MDCT/IMDCT, and applying the window to the result again, the front section 1850 with a length of N and the rear section 1855 with a length of N can be overlap-added to perfectly reconstruct the current frame "$C_{modi}D_{modi}$". At this time, the aliasing component 1845 is cancelled through the overlap-addition.

The component "$E_{part}$" included in "$C_{modi}$" and "$D_{modi}$" remains For example, as shown in FIG. 18C reconstructed "$C_{modi}D_{modi}$" 1860 becomes "$CDE_{part}$" 1865 in which the section "$E_{part}$" remains in addition to the current frame "CD". Therefore, it can be seen that the current frame is perfectly reconstructed along with a part of a look-ahead frame.

On the other hand, FIGS. 18D to 18G show signal components to which the current frame window and the MDCT/IMDCT are applied, but do not reflect the magnitude of the signals. Therefore, in consideration of the magnitude of the signals, the perfect reconstruction process shown in FIG. 18H can be performed on the basis of the result of the applycation of a trapezoidal window as shown in FIGS. 18A and 18B.

Figure 18G:
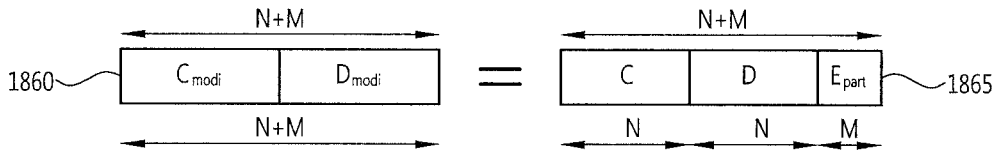
Figure 18H:
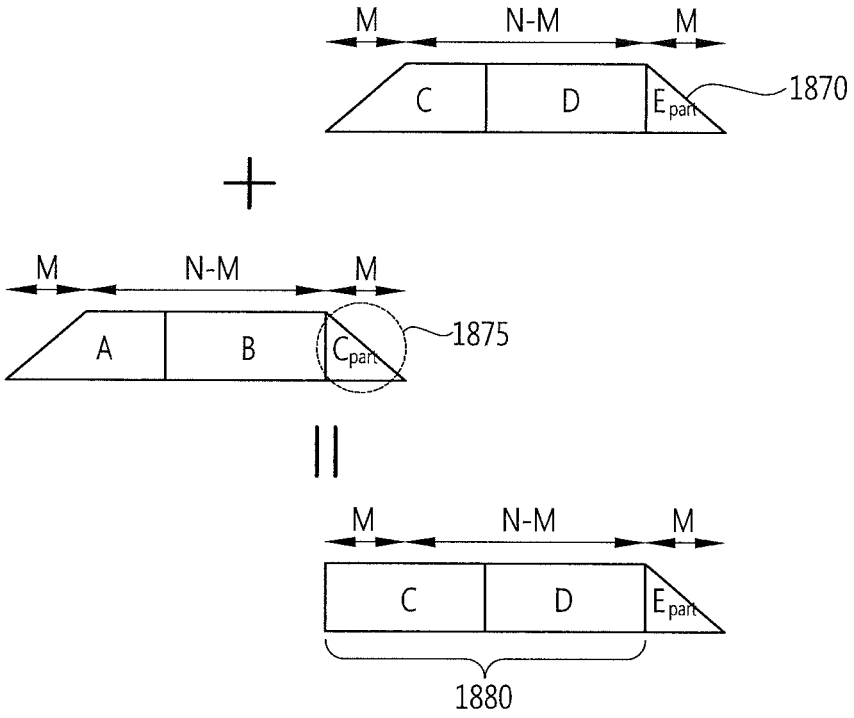

FIG. 18H is a diagram schematically illustrating a method of perfectly reconstructing a sub-frame "C" which is partially reconstructed by applying the trapezoidal window.

As described above, even when the current frame "CD" is reconstructed, the application of the trapezoidal window is not described with reference to FIG. 18G for the purpose of convenience for explanation, and thus the sub-frame section "C" needs to be perfectly reconstructed.

As shown in FIG. 18H, similarly to "$E_{part}$" included in the course of processing the current frame "CD", "$C_{part}$" included in the course of processing the previous frame "AB" is together reconstructed.

Therefore, by overlap-adding the currently-reconstructed trapezoidal "$CDE_{part}$" 1870 to the previously-reconstructed trapezoidal "$C_{part}$" 1875, the current frame "CD" 1880 can be perfectly reconstructed. At this time, "$E_{part}$" reconstructed along with the current frame "CD" can be stored in the memory for the purpose of reconstruction of a look-ahead frame "EF".

The output processor 350 outputs the reconstructed signal.

In the above-mentioned embodiments, the signals passing through the MDCT in the encoder, being output from the formatter and the de-formatter, and being subjected to the IMDCT can include an error due to quantization performed by the formatter and the de-formatter, but it is assumed for the purpose of convenience for explanation that when the error occurs, the error is included in the IMDCT result. However, by applying the trapezoidal window as described in Embodiment 8 and overlap-adding the result, it is possible to reduce the error of the quantization coefficients.

In Embodiments 1 to 8, it is described with reference to FIGS. 11 to 18 that the used window is a sinusoidal window, but this is intended only for convenience for explanation. As described above, the applicable window in the invention is a symmetric window and is not limited to the sinusoidal window. For example, an irregular quadrilateral window, a sinusoidal window, a Kaiser-Bessel Driven window, and a trapezoidal window can be applied.

Therefore, in Embodiment 8, other symmetric windows which can perfectly reconstruct the sub-frame "C" by overlap-addition can be used instead of the trapezoidal window. For example, as a window with a length of N+M having the same length as the trapezoidal window applied in FIG. 18A, a window having a symmetric shape may be used in which a part corresponding to a length of N−M has a unit size for maintaining the magnitude of the original signal and the total length of both end parts corresponding to 2M becomes the size of the original signal in the course of overlap-addition.

Figure 19:
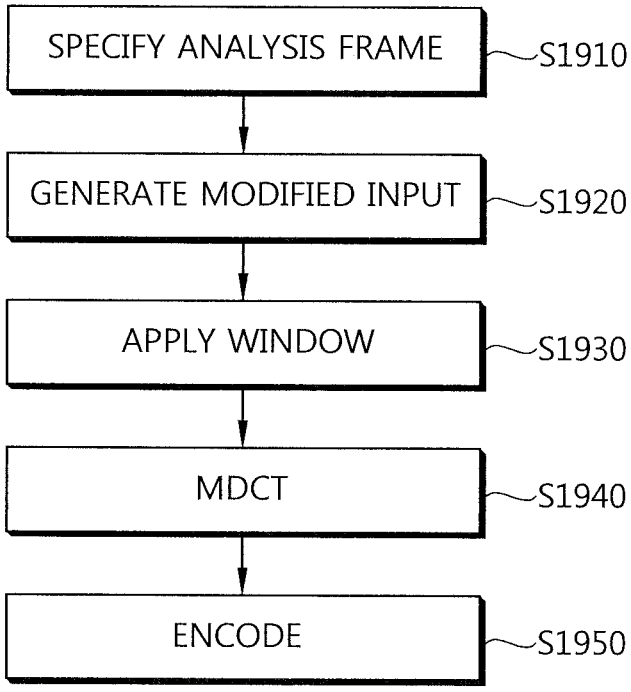
FIG. 19 is a diagram schematically illustrating a transform operation which is performed by an encoder in a system according to the invention.

FIG. 19 is a diagram schematically illustrating a transform operation performed by the encoder in the system according to the invention.

The encoder generates an input signal as a frame sequence and then specifies an analysis frame (S1910). The encoder specifies frames to be used as the analysis frame out of the overall frame sequence. Sub-frames and sub-sub-frames of the sub-frames in addition to the frames may be included in the analysis frame.

The encoder generates a modified input (S1920). As described above in the embodiments, the encoder can generate a modified input for perfectly reconstructing a signal through the MDCT/IMDCT and the overlap-addition by self-replicating the analysis frame or self-replicating a part of the analysis frame and adding the replicated frame to the analysis frame. At this time, in order to generate a modified input having a specific shape, a window having a specific shape may be applied to the analysis frame or the modified input in the course of generating the modified input.

The encoder applies the window to the modified input (S1930). The encoder can generate a process unit to which the MDCT/IMDCT should be performed by applying the windows by specific sections of the modified input, for example, by the front section and the rear section, or the front section, the intermediate section, and the rear section. At this time, the window to be applied is referred to as a current frame window so as to represent that it is applied for the purpose of processing the current frame in this specification, for the purpose of convenience for explanation.

The encoder applies the MDCT (S1940). The MDCT can be performed by the process units to which the current frame window is applied. The details of the MDCT is the same as described above.

Subsequently, the encoder can perform a process of transmitting the result of application of the MDCT to the decoder (S1950). The shown encoding process can be performed as the process of transmitting information to the decoder. At this time, the side information or the like in addition to the result of application of the MDCT can be transmitted to the decoder.

Figure 20:
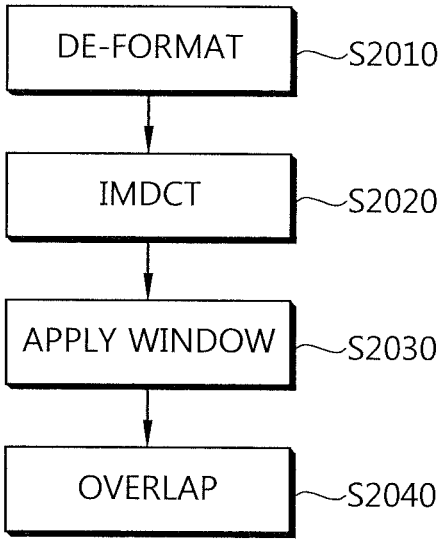
FIG. 20 is a diagram schematically illustrating an inverse transform operation which is performed by a decoder in a system according to the invention.

FIG. 20 is a diagram schematically illustrating an inverse transform operation which is performed by the decoder in the system according to the invention.

When the decoder receives the encoded information of a speech signal from the encoder, the decode de-formats the received information (S2010). The encoded and transmitted signal is decoded through the de-formatting and the side information is extracted.

The decoder performs the IMDCT on the speech signal received from the encoder (S2020). The decoder performs the inverse transform corresponding to the transform method performed in the encoder. In the invention, the encoder performs the MDCT and the decoder performs the IMDCT. Details of the IMDCT are the same as described above.

The decoder applies the window again to the result of application of the IMDCT (S2030). The window applied by the decoder is the same window as applied in the encoder and specifies the process unit of the overlap-addition.

The decoder causes the results of application of the window to overlap (overlap-add) with each other (S2040). The speech signal subjected to the MDCT/IMDCT can be perfectly reconstructed through the overlap-addition. Details of the overlap-addition are the same as described above.

For the purpose of convenience for explanation, the sections of a signal are referred to as "frames", "sub-frames", "sub-sections", and the like. However, this is intended only for convenience for explanation, and each section may be considered simply as a "block" of a signal for the purpose of easy understanding.

While the methods in the above-mentioned exemplary system have been described on the basis of flowcharts including a series of steps or blocks, the invention is not limited to the order of steps and a certain step may be performed in a step or an order other than described above or at the same time as described above. The above-mentioned embodiments can include various examples. Therefore, it should be understood that the invention includes all other substitutions, changes, and modifications belonging to the appended claims.

When it is mentioned above that an element is "connected to" or "coupled to" another element, it should be understood that still another element may be interposed therebetween, as well as that the element may be connected or coupled directly to another element. On the contrary, when it is mentioned that an element is "connected directly to" or "coupled directly to" another element, it should be understood that still another element is not interposed therebetween.

The invention claimed is:

1. A speech signal encoding method by an apparatus, the method comprising:

specifying, by the encoding apparatus, an analysis frame in an input speech signal;

generating, by the encoding apparatus, a first modified input speech, based on the analysis frame by adding replication of all or a part of the analysis frame to the analysis frame;

applying, by the encoding apparatus, a window on the first modified input to generate a second modified input and a third modified input, each of which has a same length as the window, wherein the window is of equal length or shorter than the first modified input, and the second half of the first modified input overlaps with the first half of the second modified input, and wherein the window has a symmetrical shape that includes four sub-frames with weights w1, w2, w3 and w4, the weights satisfying the condition w1w1+w3w3=w2w2+w4w4=1;

generating, by the encoding apparatus, transform coefficients by performing a Modified Discrete Cosine Transform (MDCT) on the second and third modified inputs; and encoding the transform coefficients by the encoding apparatus.

2. The speech signal encoding method according to claim 1, wherein a current frame has a length of N and the window has a length of 2N, wherein the step of applying the window includes generating the second modified input by applying the window to the front end of the first modified input and generating the third modified input by applying the window to the rear end of the first modified input.

3. The speech signal encoding method according to claim 2, wherein the analysis frame includes a current frame and a previous frame of the current frame, and wherein the first modified input is generated by adding a replication of the second half of the current frame to the analysis frame.

4. The speech signal encoding method according to claim 2, wherein the analysis frame includes a current frame, wherein the first modified input is generated by adding M replications of the first half of the current frame to the front end of the analysis frame and adding M replications of the second half of the current frame to the rear end of the analysis frame, and wherein first modified input has a length of 3N.

5. The speech signal encoding method according to claim 1, wherein the window has the same length as a current frame, wherein the analysis frame includes the current frame, wherein the first modified input is generated by adding a replication of the first half of the current frame to the front end of the analysis frame and adding a replication of the second half of the current frame to the rear end of the analysis frame, wherein the step of applying the window further comprises generating a fourth modified input, wherein the second, third, and fourth modified inputs are generated by applying the window to the first modified input while sequentially shifting the window by a half frame from the front end of the first modified input, wherein the step of generating the transform coefficients includes generating first, second and third transform coefficients by performing an MDCT on each of the second, third, and fourth modified inputs, and wherein the step of encoding the transform coefficients includes encoding the first, second, and third transform coefficients.

6. The speech signal encoding method according to claim 1, wherein a current frame has a length of N, the window has a length of N/2, and the first modified input has a length of 3N/2, wherein the step of applying the window further comprises generating fourth, fifth and sixth modified inputs, wherein the second, third, fourth, fifth, and sixth modified inputs are generated by applying the window to the first modified input while sequentially shifting the window by a quarter frame from the front end of the first modified input, wherein the step of generating the transform coefficients includes generating first, second, third, fourth, and fifth transform coefficients by performing an MDCT on the second, third, fourth, fifth, and sixth modified inputs, respectively, and wherein the step of encoding the transform coefficients includes encoding the first, second, third, fourth, and fifth transform coefficients.

7. The speech signal encoding method according to claim 6, wherein the analysis frame includes the current frame, and wherein the first modified input is generated by adding a replication of the front half of the first half of the current frame to the front end of the analysis frame and adding a replication of the rear half of the second half of the current frame to the rear end of the analysis frame.

8. The speech signal encoding method according to claim 6, wherein the analysis frame includes the current frame and a previous frame of the current frame, and wherein the first modified input is generated by adding a replication of the second half of the current frame to the analysis frame.

9. The speech signal encoding method according to claim 1, wherein a current frame has a length of N, the window has a length of 2N, and the analysis frame includes the current frame, and wherein the first modified input is generated by adding a replication of the current frame to the analysis frame.

10. The speech signal encoding method according to claim 1, wherein a current frame has a length of N and the window has a length of N+M, wherein the analysis frame is generated by applying a symmetric first window having a slope part with a length of M to the first half with a length of M of the current frame and a subsequent frame of the current frame, wherein the first modified input is generated by self-replicating the analysis frame, wherein the step of applying the window includes generating the second modified input by applying the second window to the front end of the first modified input and generating the third modified input by applying the second window to the rear end of the first modified input, wherein the step of generating the transform coefficients includes generating a first transform coefficient by performing an MDCT on the second modified input and generating a second transform coefficient by performing an MDCT on the third modified input, and wherein the step of encoding the transform coefficients includes encoding the first and second modified coefficients.

11. A speech signal decoding method by a decoding apparatus, the method comprising:

generating by the decoding apparatus, transform coefficient sequences by decoding an input speech signal, wherein the transform coefficient sequences comprise a first transform coefficient sequence and a second transform coefficient sequence;

generating, by the decoding apparatus, temporal coefficient sequences by performing an Inverse Modified Discrete Cosine Transform (IMDCT) on the transform coefficients, wherein the temporal coefficient sequence includes a first temporal coefficient sequence generated from the first transform coefficient sequence by the IMDCT, and a second temporal coefficient sequence from the second transform coefficient sequence generated by the IMDCT;

applying, by the decoding apparatus, a window on the first and second temporal coefficient sequences to generate a first modified sequence and a second modified sequence, respectively, wherein the second half of the first modified sequence overlaps with the first half of the second modified sequence, and wherein the window has a symmetrical shape that includes four sub-frame with weights w1, w2, w3 and w4, the weights satisfying the condition $w_1w_1+w_3w_3=w_2w_2+w_4w_4=1$; and outputting, by the decoding apparatus, a sample reconstructed by adding the overlapped portions of the first and second modified sequences, wherein the transform coefficient sequences are generated by applying the window to an input frame that is modified by adding replication of all or a part of the input frame to the input frame and by performing Modified Discrete Cosine Transform (MDCT).

12. The speech signal decoding method according to claim 11, wherein the step of outputting the sample includes overlap-adding the first temporal coefficient sequence and the second temporal coefficient sequence having the window applied thereto with a gap of one frame.

13. The speech signal decoding method according to claim 11, wherein the step of generating the transform coefficient sequences further comprises generating a third transform coefficient sequence of a current frame, wherein the step of generating the temporal coefficient sequence further comprises generating a third temporal coefficient sequence by performing an IMDCT on the third transform coefficient sequence, wherein the step of applying the window includes applying the window to the first, second, and third temporal coefficient sequences, and wherein the step of outputting the sample includes adding overlapped parts of the first and second temporal coefficient sequences, and the second and third temporal coefficient sequences with a gap of a half frame from a previous or subsequent frame.

14. The speech signal decoding method according to claim 11, wherein the step of generating the transform coefficient sequence further comprises generating third, fourth, and fifth transform coefficient sequences of a current frame, wherein the step of generating the temporal coefficient sequence further comprises generating third, fourth, and temporal coefficient sequences by performing an IMDCT on the third, fourth, and fifth transform coefficient sequences, respectively, wherein the step of applying the window includes applying the window to the first, second, third, fourth, and fifth temporal coefficient sequences, and wherein the step of outputting the sample includes adding overlapped parts between the first, second, third, fourth, and fifth temporal coefficient sequences with a gap of a quarter frame from a previous or subsequent frame.

15. The speech signal decoding method according to claim 11, wherein the input frame includes a current frame, wherein the modified input frame is generated by adding a replication of the input frame to the input frame, and wherein the step of outputting the sample includes overlap-adding the first half of the temporal coefficient sequence and the second half of the temporal coefficient sequence.

16. The speech signal decoding method according to claim 11, wherein a current frame has a length of N and the window is a first window having a length of N+M, wherein the input frame is generated by applying a symmetric second window having a slope part with a length of M to the first half with a length of M of the current frame and a subsequent frame of the current frame, wherein the modified input is generated by self-adding replication of the input frame to the input frame, and wherein the step of outputting the sample includes overlap-adding the first half of the temporal coefficient sequence and the second half of the temporal coefficient sequence and then overlap-adding the overlap-added first and second halves of the temporal coefficient to the reconstructed sample of a previous frame of the current frame.

* * * * *